US011065635B2

(12) United States Patent
Ballot et al.

(10) Patent No.: US 11,065,635 B2
(45) Date of Patent: Jul. 20, 2021

(54) CONTAINER APPENDAGE

(71) Applicant: FLOCON, Inc., Woodstock, IL (US)

(72) Inventors: Stephan M. Ballot, Barrington Hills, IL (US); David A. Snyder, Sharon, WI (US); Fred M. Ekstrom, Algonquin, IL (US); Robert D. Forschler, Lakewood, IL (US); Thomas A. Nelsen, Wauconda, IL (US)

(73) Assignee: FLOCON, INC., Woodstock, IL (US)

( * ) Notice: Subject to any disclaimer, the term of this patent is extended or adjusted under 35 U.S.C. 154(b) by 0 days.

(21) Appl. No.: 16/591,989

(22) Filed: Oct. 3, 2019

(65) Prior Publication Data

US 2020/0108407 A1 Apr. 9, 2020

Related U.S. Application Data

(60) Provisional application No. 62/741,165, filed on Oct. 4, 2018.

(51) Int. Cl.
*B65D 83/20* (2006.01)
*B05B 11/00* (2006.01)

(52) U.S. Cl.
CPC ..... *B05B 11/3057* (2013.01); *B65D 83/202* (2013.01)

(58) Field of Classification Search
CPC ..... B05B 11/3057; B65D 83/202
See application file for complete search history.

(56) References Cited

U.S. PATENT DOCUMENTS

| | | | | |
|---|---|---|---|---|
| 3,897,006 | A | 7/1975 | Tada | |
| 3,913,841 | A | 10/1975 | Tada | |
| 4,199,083 | A | 4/1980 | LoMaglio | |
| 4,273,268 | A | 6/1981 | Wickenbeng | |
| 4,434,917 | A * | 3/1984 | Saito | B05B 11/3014 222/321.8 |
| 4,527,741 | A | 7/1985 | Garneau | |
| 4,558,821 | A | 12/1985 | Tada | |
| 4,646,969 | A | 3/1987 | Sorm | |
| 4,826,052 | A | 5/1989 | Micallef | |
| 4,955,511 | A | 9/1990 | Blake | |
| 5,054,659 | A | 10/1991 | Micallef | |
| 5,318,206 | A | 6/1994 | Maas | |
| 5,341,967 | A | 8/1994 | Siivenis | |
| 5,344,053 | A | 9/1994 | Foster | |
| 5,402,916 | A | 4/1995 | Nottingham | |
| 5,492,275 | A | 2/1996 | Crampton | |

(Continued)

OTHER PUBLICATIONS

U.S. Appl. No. 29/665,555, Flocon.

*Primary Examiner* — Jeremy Carroll
(74) *Attorney, Agent, or Firm* — Frijouf, Rust & Pyle, P.A.

(57) ABSTRACT

A container appendage is disclosed comprising a mounting ring having an upper surface, a lower surface, an exterior edge and an interior edge for defining a mounting aperture. A platform member is coupled to the mounting ring. The mounting ring is coupled between the bottle and the spray body for defining a mounting ring couple. The platform member cantilevers above the handling neck and adjacent to the rear surface for defining a rear ergonomical handling member for conforming to the hand and improving ergonomical grasping of the handling neck, actuating the trigger and lifting the spray bottle by the hand.

28 Claims, 21 Drawing Sheets

(56) References Cited

U.S. PATENT DOCUMENTS

| | | | | |
|---|---|---|---|---|
| 5,704,521 | A | 1/1998 | Grogan | |
| 5,711,459 | A | 1/1998 | Glynn | |
| 5,810,209 | A | 9/1998 | Foster | |
| 5,996,847 | A | 12/1999 | Smolen | |
| 6,234,412 | B1 | 5/2001 | von Schuckmann | |
| 6,364,174 | B1 | 4/2002 | Lohrman | |
| 6,439,481 | B2 | 8/2002 | von Schuckman | |
| 6,533,144 | B2 * | 3/2003 | Davies | B05B 11/3001 222/153.13 |
| 6,595,246 | B2 | 7/2003 | Brozell | |
| 6,910,605 | B2 | 6/2005 | Schuckmann | |
| 9,004,322 | B2 | 4/2015 | Graham | |
| 2004/0222243 | A1 | 11/2004 | Sweeton | |
| 2005/0173560 | A1 | 8/2005 | Bitowft | |
| 2007/0158368 | A1 | 7/2007 | Tada | |
| 2010/0108857 | A1 * | 5/2010 | Andrae | B05B 15/62 248/692 |
| 2016/0001962 | A1 * | 1/2016 | Lee | B65D 83/206 222/402.15 |
| 2017/0036231 | A1 | 2/2017 | Conway et al. | |
| 2017/0100735 | A1 * | 4/2017 | Taylor | B05B 11/3045 |

* cited by examiner

CONTAINER APPENDAGE

CROSS-REFERENCE TO RELATED APPLICATIONS

This application claims benefit of U.S. Patent Provisional application No. 62/741,165 filed Oct. 4, 2018. All subject matter set forth in provisional application No. 62/741,165 is hereby incorporated by reference into the present application as if fully set forth herein.

BACKGROUND OF THE INVENTION

Field of the Invention

This invention relates to the container supports and more particularly, this invention relates to a container appendage for improving the ergonomical handling of a trigger pump dispenser.

Background of the Invention

Various types of trigger pump dispensers have been devised for dispensing a wide range of liquids and fluids. These trigger pump dispensers of the prior art have received wide acceptance due in great measure to the convenience of the devices. Prolonged usage of the trigger pump dispenser may lead to fatigue of the hand leading to either discontinuing use of the trigger pump dispenser or the trigger pump dispenser slipping out of the hand of the user. It is most desirable for a trigger pump dispenser to provide an efficient ergonomical engagement with the hand of a user. It is also desirable for a trigger pump dispenser that may be utilized for extended periods of time by the user as well prevent the inadvertent slippage of the trigger pump dispenser from the hand of the user. In addition, it is desirable for a trigger pump dispenser that may provide an engagement with the hand for supporting the weight of the overall trigger pump dispenser and allowing the fingers of the hand for solely actuating the trigger. The following patents and publications are representative of attempts of the prior art to advance the trigger pump art.

U.S. Pat. No. 3,897,006 to Tada discloses a sprayer including a container for receiving a liquid therein, a sprayer head having a piston for sucking and ejecting the liquid from a nozzle, and a neck portion coupling the head to the container, the neck portion having a vent for permitting the interior of the container to communicate with the open air. The vent is normally closed by a flexible closing member and, when the piston is operated, is opened by an operating rod to release a negative pressure within the container.

U.S. Pat. No. 3,913,841 to Tada discloses a sprayer adapted to suction a liquid under back pressure and squirt the liquid in the atomized form from the nozzle by applying a pressure to the liquid. The sprayer comprises a sprayer body having a suction pipe and a cylinder communicating with the suction pipe, and a cylindrical projection extending from the closed end toward the open end of the cylinder and communicating with the suction pipe. A piston is slidably mounted to the sprayer body in a manner to surround the cylindrical projection. The piston defines such a liquid chamber that when the piston is moved into closest proximity to the closed end of the cylinder the volume of the liquid chamber is made minimal. As a result, when the piston is so moved, a liquid within the chamber is squirted efficiently at high pressure.

U.S. Pat. No. 4,199,083 to LoMaglio discloses a manually actuated trigger pump adapted to be fitted on the neck of a container for dispensing a liquid therefrom. The pump includes a main housing with a trigger connected thereto, a flexible bladder which fits in the housing and is engagable by the trigger, and a nozzle which is attached to the housing. The trigger engages the bladder to pump fluid from the bladder outwardly through the nozzle.

U.S. Pat. No. 4,273,268 to Wickenberg discloses a fluid spray pump for spraying a fluid from a fluid container through a terminal orifice comprising a housing having an internal cylinder with a first and a second end. A collar with an internal collar aperture is mounted adjacent the first end of the housing internal cylinder. A pump barrel is slidably received in the internal collar aperture and includes a barrel internal bore communicating with a terminal orifice in the pump barrel. A piston comprising a piston stem is received in the barrel internal bore of the piston barrel and with a piston head received within the housing internal cylinder. Channels are provided along the piston stem for communicating the housing internal cylinder with the terminal orifice. An annular seal is slidably mounted relative to the piston and the pump barrel for sealing the channel means when the annular seal abuts a shoulder formed between the piston head and the piston stem. The annular seal enables fluid flow through the channel means to the terminal orifice when the annular seal is displaced from the piston shoulder by movement of the pump barrel toward the second end of the housing internal cylinder U.S. Pat. No. 4,527,741 to Garneau discloses a trigger sprayer comprising a body having an upper horizontally extending portion and a lower generally vertically extending portion. The body has a passageway therein extending from one end of the upper portion to the bottom of the lower portion. A cylindrical hollow and a cylindrical cavity extend into the lower body portion from the bottom thereof. An insert member is adapted to be received in the hollow and cavity, and has a passageway therethrough communicating with the body passageway, a cap coupled to the lower end of the insert member to a container of fluid. A check valve assembly is associated with the insert member to a container of fluid. A check valve assembly is associated with the insert member passageway and includes a lower check valve. At least one of the valves includes an elongate valve member and a frusto-conical shaped skirt extending forwardly from the valve member. A pumping assembly is mounted to the body and communicates with the insert member passageway between the upper and lower check valves.

U.S. Pat. No. 4,558,821 to Tada discloses a trigger-type sprayer according to the present invention sucks up, pressurizes and sprays a liquid contained in a container having a mouth portion. The sprayer is provided with a housing attached to the mouth portion of the container, a trigger rockably attached to one end portion of the housing, a nozzle formed on the trigger and having an orifice, a cylinder supported at the middle portion on the housing and capable of facing the orifice, a suction tube attached to the other end portion of the cylinder and connecting the interior of the cylinder and that of the container, a piston one end of which is connected to the nozzle and the other end of which is located in the cylinder, the piston slidably touching the inner surface of the cylinder, a primary valve for selectively connecting the suction tube and the cylinder, and a secondary valve for selectively connecting the cylinder and the piston. The housing, trigger, nozzle, cylinder and suction tube are integrally formed.

U.S. Pat. No. 4,646,969 to Sorm, et al. discloses a double-acting mechanical liquid spraying device having a housing which is adapted to be mounted upon and sealed to the neck of a liquid container, and which has a liquid-containing compartment therein. In the housing, aligned with the liquid-containing compartment, there is an operation cylinder which has an annular valve seat disposed transversely to and intermediate the length of such cylinder. Disposed within the liquid-containing compartment is a liquid pumping plunger of the cuff type which cooperates with the valve seat to close the opening through such seat when the plunger is in its forward terminal position, and which is driven to reciprocate within the liquid-containing compartment in forward and reverse liquid dispensing strokes. In each of such strokes the plunger forwards liquid from the liquid-containing compartment to a spray nozzle through a liquid-conducting passage. Interposed in the liquid-conducting passage between the plunger and the spray nozzle are a relief valve and a relief passage which bleed liquid back to the liquid container and allow atmospheric air to be drawn in through the spray nozzle at the end of the reverse stroke of the plunger, thereby to clear the spray nozzle of liquid at the end of each pumping cycle consisting of a forward and a reverse stroke. As a consequence, fast-drying liquids can be sprayed with the device of the invention.

U.S. Pat. No. 4,826,052 to Micallef discloses a dispensing pump for dispensing product from a container and serves as a container closure. The pump has a cylinder having an inner shell open at its rear end and closed at a forward end and an outer shell surrounding the inner shell and defining a cavity therebetween. A reciprocally mounted piston is in the inner shell and defines a pump chamber therewith. Inlet port means includes a passage in the outer shell for communication the container interior with the pump chamber during the suction stroke to permit product to pass through the inlet port into the cavity and then into the pump chamber. A vent replaces product removed from the container interior into the pump chamber with air. An outlet valve is provided for opening the outlet port during the compression stroke and for closing the outlet port during the suction stroke; and an inlet valve is provided for opening the inlet port during the suction stroke and for closing the inlet port during the compression stroke.

U.S. Pat. No. 4,955,511 to Blake discloses an inexpensive, disposable trigger actuated pump in which the shroud and nose piece are molded as a single unit. In one form of the invention, the pump housing is molded as a single unit with the shroud and nose piece, and a trigger actuator and piston pump are also molded as a single unit for subsequent assembly with the shroud, housing and nose piece unit, return spring, nose valve, dip tube and container to form a completed pump. The trigger actuated pump of the invention thus comprises fewer parts than conventionally manufactured pumps, thereby reducing inventory requirements and assembly steps and consequently reducing the manufacturing costs, enabling the pump to be disposed of after the contents of the container are emptied.

U.S. Pat. No. 5,054,659 to Micallef discloses a double acting trigger pump on a container includes a cylinder and a piston reciprocal therein that cooperate in providing a primary pump chamber. An inlet valve regulates product being drawn into the primary pump chamber. A double piston seal is at the inner end of the piston and includes an outlet valve coaxial with a longitudinal bore in the piston. A supplemental pump chamber that also communicates with the bore is defined between outer surfaces of the piston and inner surfaces of the cylinder as well as the double piston seal and a rearward retaining ring. During the pressure stroke of the piston, product is dispensed from the primary pump chamber out from the pump and fills the supplemental pump chamber. During the suction stroke of the piston, product is drawn into the primary pump chamber from the container and product is discharged from the supplemental pump chamber out from the pump.

U.S. Pat. No. 5,318,206 to Maas, et al. discloses a trigger operated pumping mechanism for a fluid dispensing device having a body and the pumping mechanism comprises a cylinder in the body of the dispensing device, a piston received in the cylinder and having a piston rod extending outwardly therefrom to an outer end and a trigger movably mounted to the body and having a front side and a back side. A first coupling structure is provided on the outer end of the piston rod for coupling to the trigger. A second coupling structure is provided on the back side of the trigger for releasably coupling to the first coupling structure on the piston rod in a snap-fitting manner and a spring is provided outside of the cylinder for biasing the trigger away from the body.

U.S. Pat. No. 5,341,967 to Silvenis discloses a trigger sprayer dispenser which can be used to dispense liquids in multidirections. The present invention incorporates a mechanism in a conventional trigger sprayer to allow the sprayer to be used in an inverted position without the dispenser contents leaking through a sprayer vent orifice. The mechanism comprises a by pass chamber in communication with the chamber of the dip tube. The by pass chamber then creates an auxiliary fluid path to the dip tube fluid path when the dispenser is inverted. When the dispenser is inverted, the fluid remaining in the dip tube acts as a fluid lock thereby preventing internal dispenser air from escaping out from the dip tube into the trigger sprayer. The by pass mechanism therefore, also allows for more efficient evacuation of the dispenser contents.

U.S. Pat. No. 5,344,053 to Foster, et al. discloses a trigger sprayer apparatus is including a sprayer housing and a vent housing that are formed independently of each other and are then assembled together. By providing a separate sprayer housing and vent housing, the sprayer apparatus may be produced in a manner that significantly reduces the occurrence of deformations or imperfections in the component parts of the apparatus. Molding the sprayer housing and vent housing separately enables the cylindrical interior surface of the pump chamber and the cylindrical interior surface of the vent chamber to be molded more accurately. Because the sprayer and vent housings are molded separately, a lesser amount of material is needed to mold each of these components and therefore shrinkage of the material as the components cool is significantly reduces. This eliminates the occurrence of deformations or sinks in critical areas of these component parts.

U.S. Pat. No. 5,402,916 to Nottingham, et al. discloses a hand-actuated multiple-container trigger sprayer including a sprayer head assembly removably connected to a plurality of fluid containers. The sprayer head assembly has an outer housing, a nozzle attached to the housing, pump mechanism enclosed within the housing, and tubing fluidly connecting each of the plurality of fluid containers with the pump mechanism in the housing. A trigger or lever actuates the pump mechanism to draw fluid through the tubing from each of the plurality of fluid containers and to discharge the fluid through the nozzle. A metering device is located between the fluid containers and the pump mechanism and is accessible externally from the housing to selectively control the amount of fluid drawn from the containers. The metering device includes flow paths to the pump mechanism for each of the fluid containers. The diameter and length of at least one of the flow paths can be controlled to selectively control the amount of fluid drawn from the fluid containers.

U.S. Pat. No. 5,492,275 to Crampton discloses a hand pump sprayer and system for dispensing viscous liquids. A nozzle is rotatably mounted around the delivery passageway of a hand pump sprayer. The nozzle is interconnected to the trigger of the hand pump sprayer so that the nozzle rotates, upon pulling of the trigger, simultaneously with the discharge of the liquid to the atmosphere. The nozzle rotates about an axis of rotation through the center of the discharge end of the nozzle through an angle of rotation from about 90 degrees to about 360 degrees, desirably from 180 degrees to 360 degrees and preferably 270 degrees or more. Desirably the nozzle has two discharge outlets which direct fluid expelled from the hand pump sprayer along intersecting discharge axes. Simultaneously as the fluid is discharged along the intersecting axes, the nozzle is rotated about the axis of rotation. The resulting dispensed liquid has a high degree of atomization and a desirable round spray pattern.

U.S. Pat. No. 5,711,459 to Glynn discloses a continuous action trigger sprayer for spraying liquid material. It includes a main housing having connectors to a container and having an operation cylinder and a liquid chamber. It also includes a pumping element which is within the operation cylinder and has a valve seat, a one-way valve and a pumping rod, which permits liquid material to pass therethrough in a relative direction toward a spray nozzle, but not toward the liquid chamber. There is a relief valve having a seat with an opening therethrough and a relief passage to bleed liquid back to the container and which cooperates with the pumping element. There is also a trigger which moves the pumping element.

U.S. Pat. No. 5,810,209 to Foster discloses a dispenser comprising a container for containing fluid to be dispensed and a manually operated reciprocating fluid pump adapted to be secured to the container. The fluid pump includes a pump mechanism, an intake port adapted for fluid communication with liquid contained in the container, an intake liquid flow path providing fluid communication between the intake port and the pump mechanism, a discharge port, a discharge liquid flow path providing fluid communication between the pump mechanism and discharge port, and a closure cap portion configured for connection to the container. The closure cap portion comprises a generally annular-shaped skirt, a lug extending generally radially inwardly from an inside surface of the skirt, and an aperture in the skirt and circumferentially spaced from the lug. The container includes a neck having a mouth therein for passage therethrough of liquid in the container. The container further includes a bayonet provision on an outer surface of the neck for matably receiving the lug of the closure cap portion, and a radially extending tab configured for extending into the aperture of the skirt. The lug is shaped and configured to mate with the bayonet provision and the tab is shaped and configured to mate with the aperture when the skirt of the closure cap portion is positioned on the neck of the container to releasably lock the closure cap portion to the neck of the contain U.S. Pat. No. 5,996,847 to Smolen, Jr., et al. discloses a pair of substantially identical unitary plastic molded units, each unit having a tubular stem formed with a piston at one end and a nozzle head at the other. Each unit has a female snap-type connector facing to one side and spaced therefrom a male snap-type connector facing to the same side, the molded units being disposed side-by-side with the male snap-type connectors snappingly received into the female snap-type connectors of the respective stems.

U.S. Pat. No. 6,234,412 to von Schuckmann discloses a spray pump capable of being actuated by a hand lever, to be mounted on dispensers or the like. The pump comprises a piston pump capable of sliding linearly in a pump chamber on the housing side. The piston is connected, on the rear side of an outlet, to the hand lever and returns to its base position urged by a spring. The invention aims at producing a pump which is both simple and reliable by associating two articulating parts with the lever. One of the parts is located so as to slide in a linear slider on the housing side, and the other is fixed to the housing, on the side opposite the outlet, such that the two articulating parts are connected by mutually collapsible contiguous parts.

U.S. Pat. No. 6,364,174 to Lohrman, et al. discloses a piston/nozzle unit retainer and stop comprises inward fingers in the cylinder slots receiving the trigger trunions which drive the unit.

U.S. Pat. No. 6,439,481 to von Schuckman discloses a hand lever-operated spray pump, particularly for attaching to bottles or similar, having a pump plunger which moves linear in a pump chamber on the housing side and which is connected with the hand lever at the rear of a mouth piece opening and which returns to its starting position as a result of a spring loading, and proposes, for the purpose of achieving a structurally simple, functionally reliable solution, to allocate two hinge points to the hand lever one of which is movable in a linear guide on the housing side and the other is arranged on the housing on the side opposite to the mouthpiece. In such a way that both hinge points are connected by means of two buckling bridge sections.

U.S. Pat. No. 6,595,246 to Brozell, et al. discloses a pump body mounted on a container and has a forward manually operated pump and a rearward vertical container fill conduit. In the filling process, the container is filled through the conduit, and a closure is then applied to the top of the conduit. The closure may be part of the pump body housing. Multiple containers with their pump bodies may be filled simultaneously.

U.S. Pat. No. 6,910,605 to Schuckmann, et al. discloses a pump which is actuable by a hand lever for spraying liquid, especially for placing on bottles with a pump piston which is linearly displacable in a pump chamber on a housing side, against force of a compression spring, for spraying the liquid out of a mouthpiece nozzle. The pump piston being coupled to the pin-mounted hand lever by a connecting pull member, the connecting pull member, extending from a rear side of the pump piston, parallel to the displacement path of the pump piston in the direction of the mouthpiece nozzle, and a cross-piece on the rear side of the pump piston as a carrier of the pump piston, forming a single element therewith, wherein bearing pin portions of the hand lever are hooked into open slits, loaded by compressive force of the compression spring toward a slit end, and wherein an opening, which is partially surrounded by a frame-shaped the connecting pull member in longitudinal direction of the pump, is pivotable on a hand lever side of a compressed the compression spring over end of a carrying tube to be fitted with mouthpiece.

U.S. Pat. No. 9,004,322 to Graham discloses a hand held spray bottle for use in the downward application of a liquid onto a horizontal surface. The spray bottle generally comprises a liquid spray device and a liquid storage bottle with an open threaded top to which the spray device is attached. The liquid spray device contains an internal pump assembly, trigger, and nozzle.

United States Patent Application 2004/0222243 to Sweeton discloses a low-cost, in-line trigger actuated pump sprayer having a pump body which may have an integral container closure and/or integral shroud cover with a trigger lever trunnion mounted to the pump body or with a trigger lever assembly mounted to the pump body as including a living hinge. A hollow pump piston defines a discharge passage lying perpendicular to the central axis of the closure, and an elastomeric element may be provided with functions as a piston return spring, inlet check valve and discharge check valve.

Although the forgoing patents have contributed to the advancement of the prior art, there is still a need for a trigger pump dispenser with improving ergonomical handling.

Therefore, it is an object of the present invention to provide an improved container appendage coupled to a trigger pump dispenser for improving ergonomical handling.

Another object of the present invention is to provide a container appendage that may be coupled to a trigger pump dispenser.

Another object of the present invention is to provide a container appendage that is integrally formed with the spray body of the trigger pump dispenser.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention and the detailed description describing the preferred embodiment of the invention.

SUMMARY OF THE INVENTION

The present invention is defined by the appended claims with the specific embodiments shown in the attached drawings. For the purpose of summarizing the invention, the invention comprises a container appendage for engaging a bottle. The bottle has a bottle fitment. The bottle has a handling neck below the bottle fitment. The handling neck has a front surface, a rear surface, first side surface and a second side surface for grasping by a hand. A spray body has a body fitment. The body fitment engages with the bottle fitment for coupling the spray body with the bottle. The spray body dispenses a liquid from a nozzle upon actuating a trigger. The container appendage comprises a mounting ring having an upper surface, a lower surface, an exterior edge and an interior edge for defining a mounting aperture. A platform member is coupled to the mounting ring. The mounting ring is coupled between the bottle and the spray body for defining a mounting ring couple. The platform member cantilevers above the handling neck and adjacent to the rear surface for defining a rear ergonomical handling member for conforming to the hand and improving ergonomical grasping of the handling neck, actuating the trigger and lifting the spray bottle by the hand.

In one embodiment of the invention, the platform member may include a curved lower surface. The curved lower surface of the platform member extends from the handling neck and adjacent to the rear surface for defining a curved rear ergonomical handling member for conforming to the hand and improving ergonomical grasping of the handling neck, actuating the trigger and lifting the spray bottle by the hand.

In another embodiment of the invention, a first concave side wall is coupled to the mounting ring and the platform member for positioning adjacent the first side surface of the handling neck. The first concave side wall cantilevers above the handling neck and adjacent to the first side surface of the handling neck for defining a first ergonomical side handling member for conforming to the hand and improving ergonomical grasping of the handling neck, actuating the trigger and lifting the spray bottle by the hand. A second concave side wall is coupled to the mounting ring and the platform member for positioning adjacent the second side surface of the handling neck. The second concave side wall cantilevers above the handling neck and adjacent to the second side surface of the handling neck for defining a second ergonomical side handling member for conforming to the hand and improving ergonomical grasping of the handling neck, actuating the trigger and lifting the spray bottle by the hand.

In another embodiment of the invention, an improved spray dispenser dispensing a liquid. A hand engages the spray dispenser. The improved spray body comprises a spray body including a nozzle for dispensing the liquid upon actuating a trigger pivotably mounted on the spray body. The spray body includes an upper surface and a lower surface. A spray body fitment is coupled to the spray body. A spray bottle stores the liquid. The spray bottle includes a bottle fitment. The bottle fitment engages the spray body fitment for coupling the spray bottle with the spray body. The spray bottle has a handling neck below the bottle fitment. The handling neck has a front surface, a rear surface, first side surface and a second side surface for grasping by the hand. A platform member is coupled to the spray body. The platform member cantilevers above the handling neck and adjacent to the rear surface for defining a rear ergonomical handling member for conforming to the hand and improving ergonomical grasping of the handling neck, actuating the trigger and lifting the spray bottle by the hand.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments may be modified for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
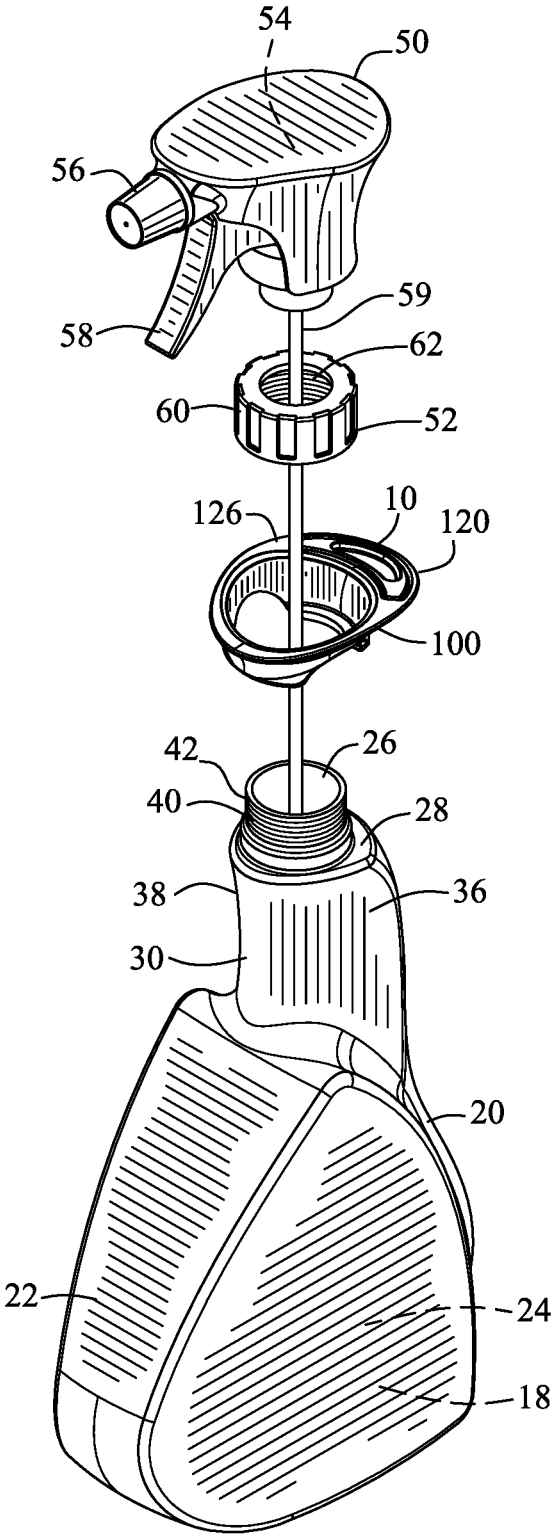
FIG. 1 is an exploded isometric view a first embodiment of a container appendage of the present invention positioned between a bottle and a spray body.
Figure 2:
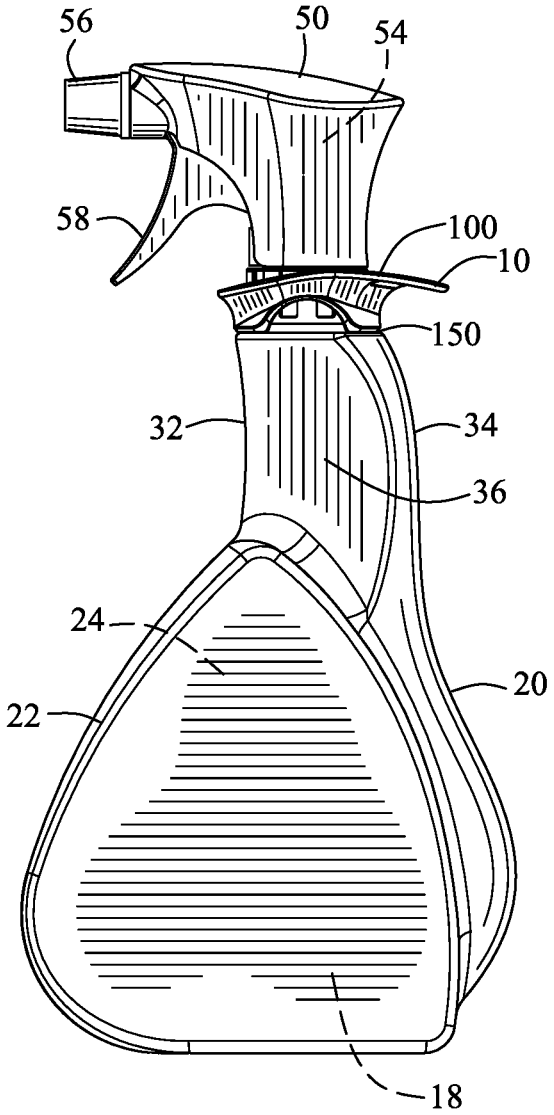
FIG. 2 is right side view of FIG. 1.
Figure 3:
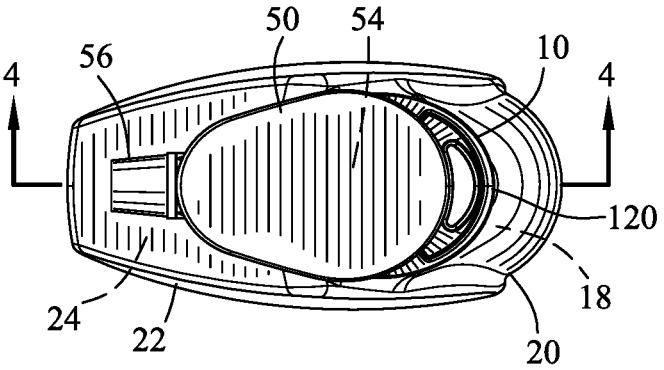
FIG. 3 is a top view of FIG. 2.
Figure 4:
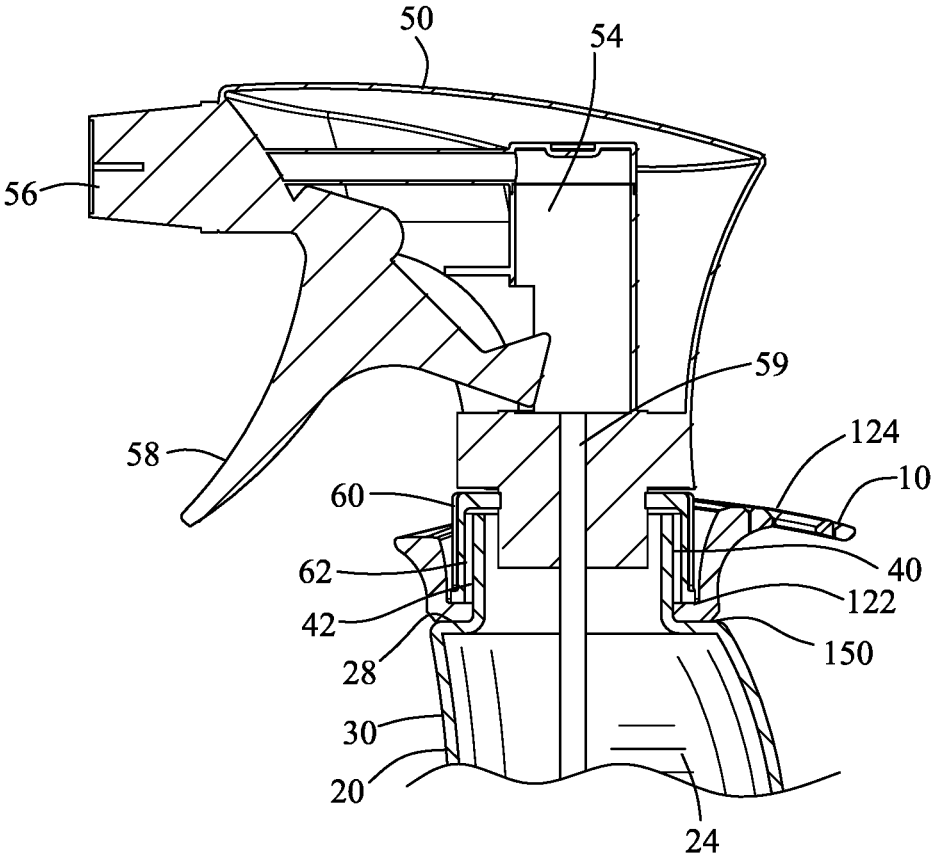
FIG. 4 is a sectional view along line 4-4 in FIG. 3.
Figure 7:
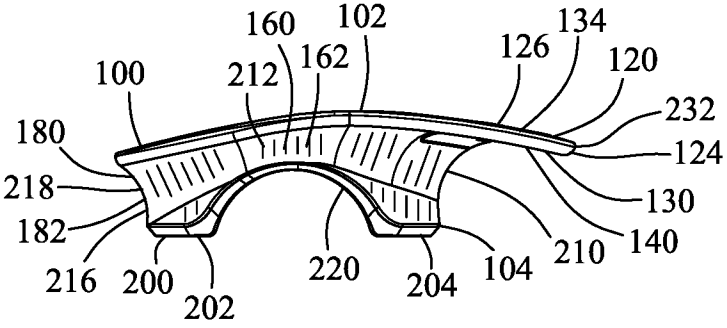
FIG. 7 is right side view of FIG. 5.
Figure 8:
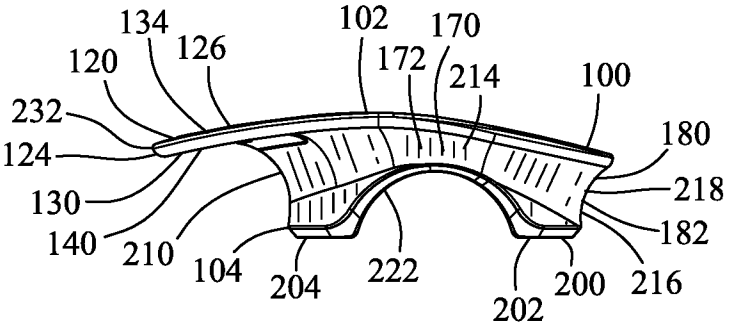
FIG. 8 is a left side view of FIG. 5.
Figure 5:
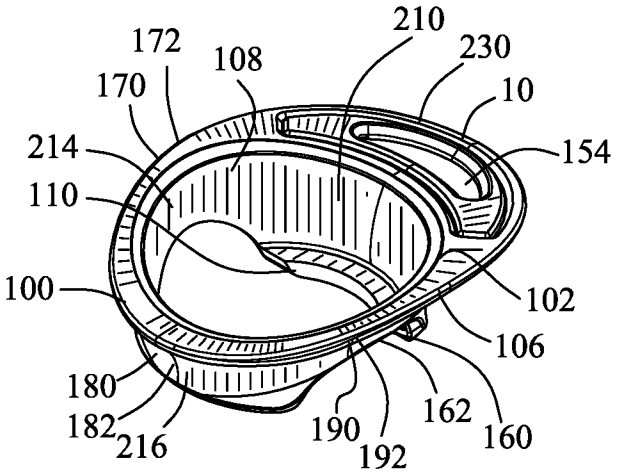
FIG. 5 is an upper isometric view of the container appendage of FIG. 1.
Figure 6:
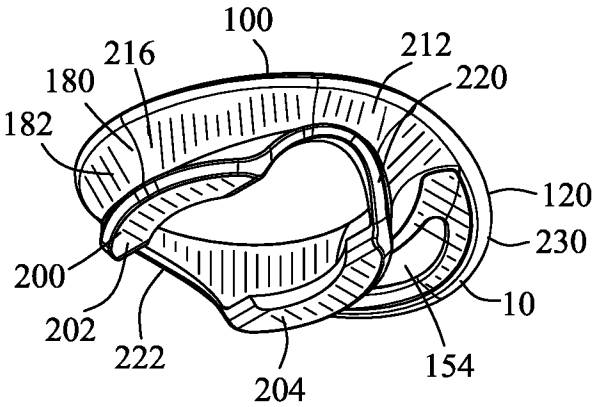
FIG. 6 is a lower isometric view of FIG. 5.
Figure 12:
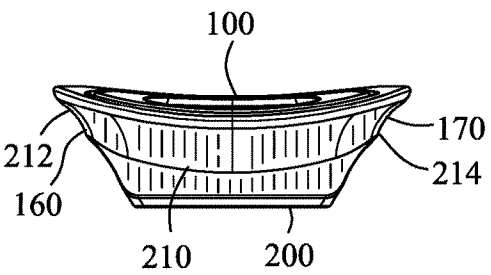
FIG. 12 is a rear view of FIG. 5.
Figure 11:
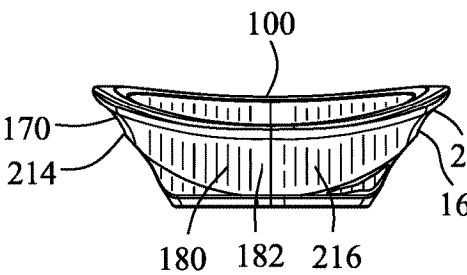
FIG. 11 is a front view of FIG. 5.
Figure 9:
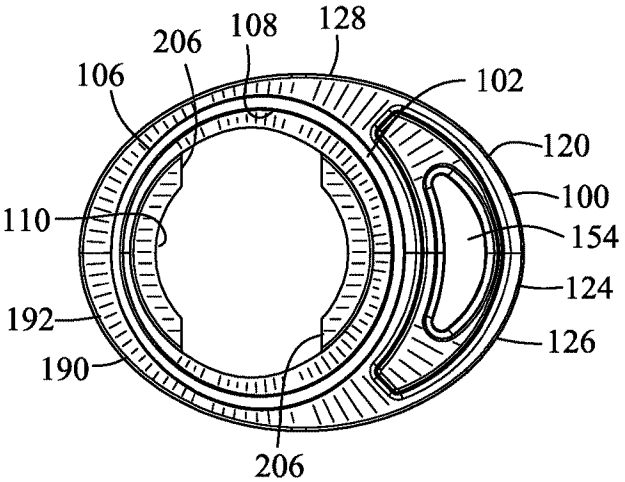
FIG. 9 is a top view of FIG. 5.
Figure 10:
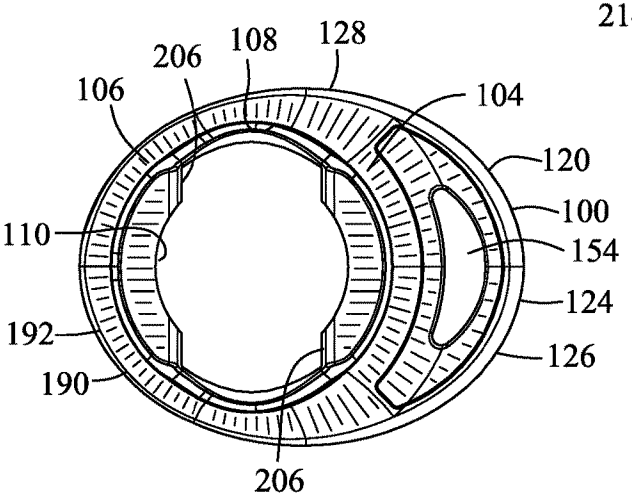
FIG. 10 is a bottom view of FIG. 5.
Figure 14:
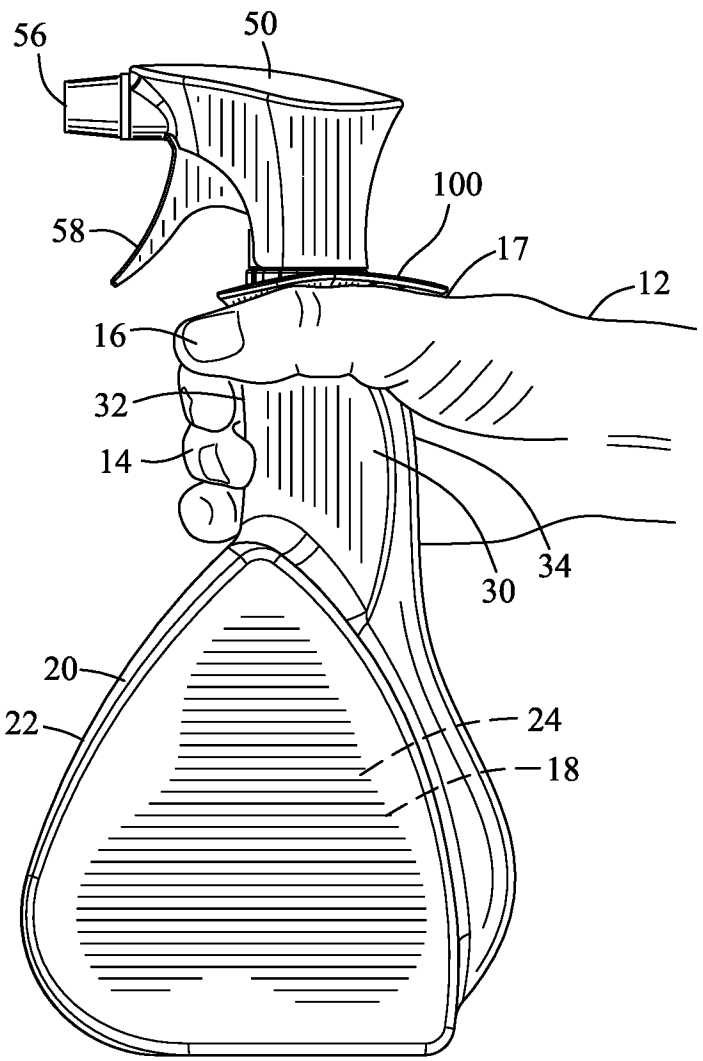
FIG. 14 is a view similar to FIG. 13 illustrating the hand engaging with the container appendage.
Figure 13:
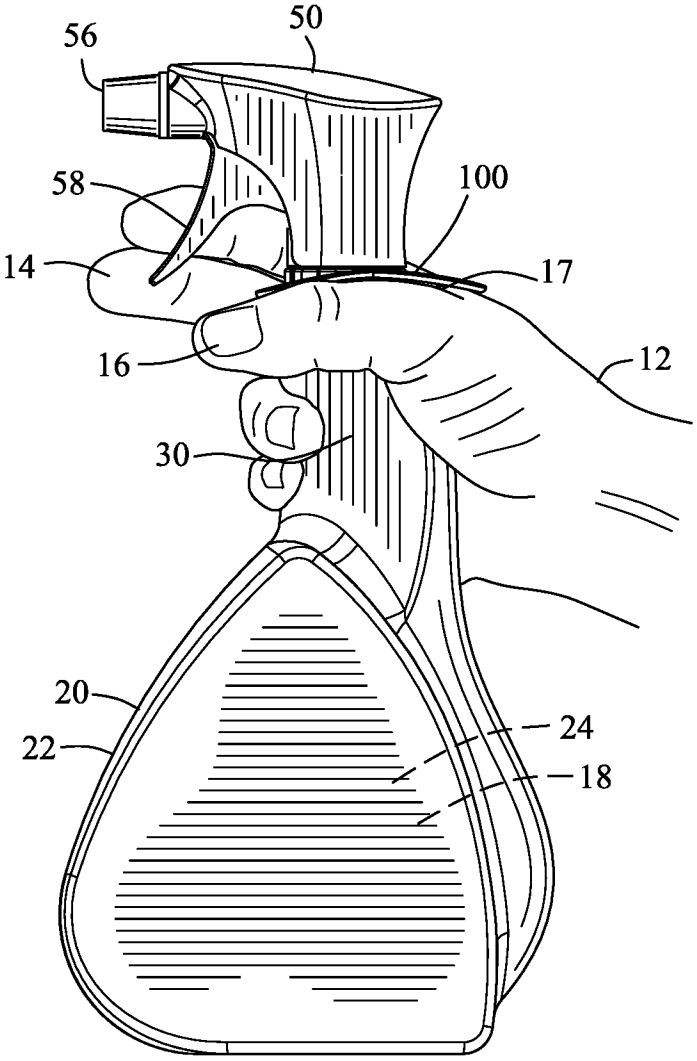
FIG. 13 is a view similar to FIG. 2 illustrating the hand engaging with the container appendage and the fingers engaging the trigger for dispensing a fluid.
Figure 15:
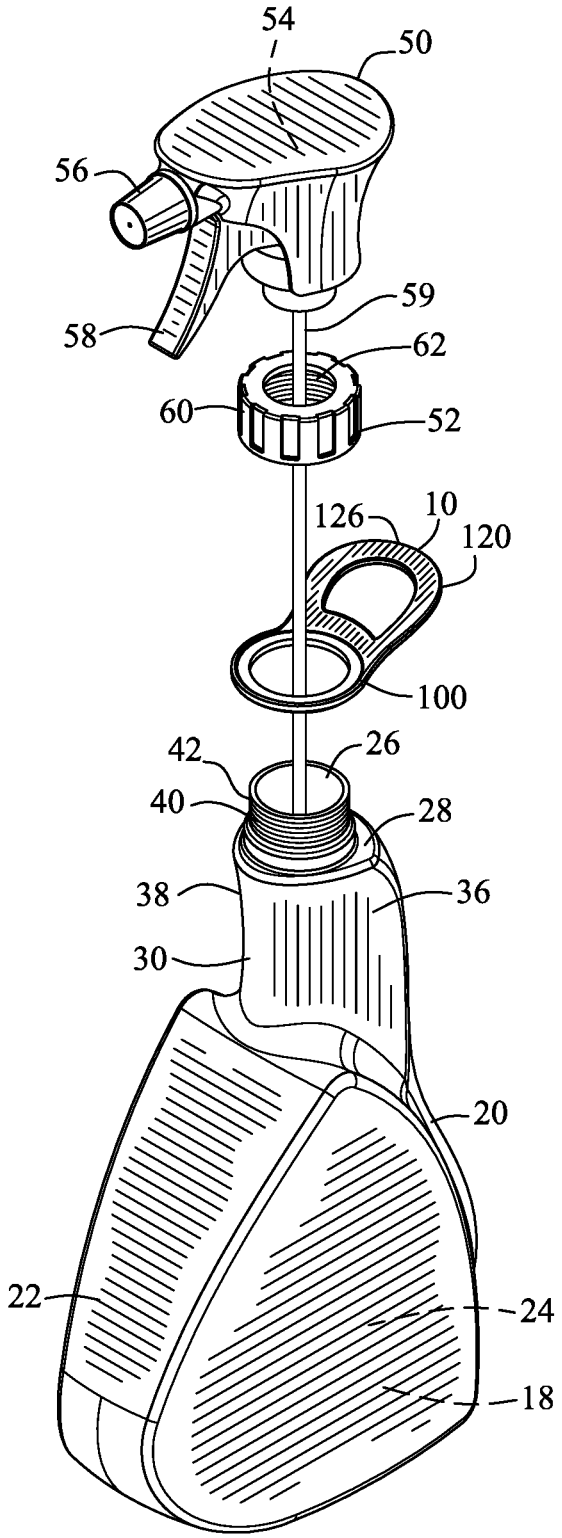
FIG. 15 is an exploded isometric view a second embodiment of a container appendage of the present invention positioned between a bottle and a spray body.
Figure 16:
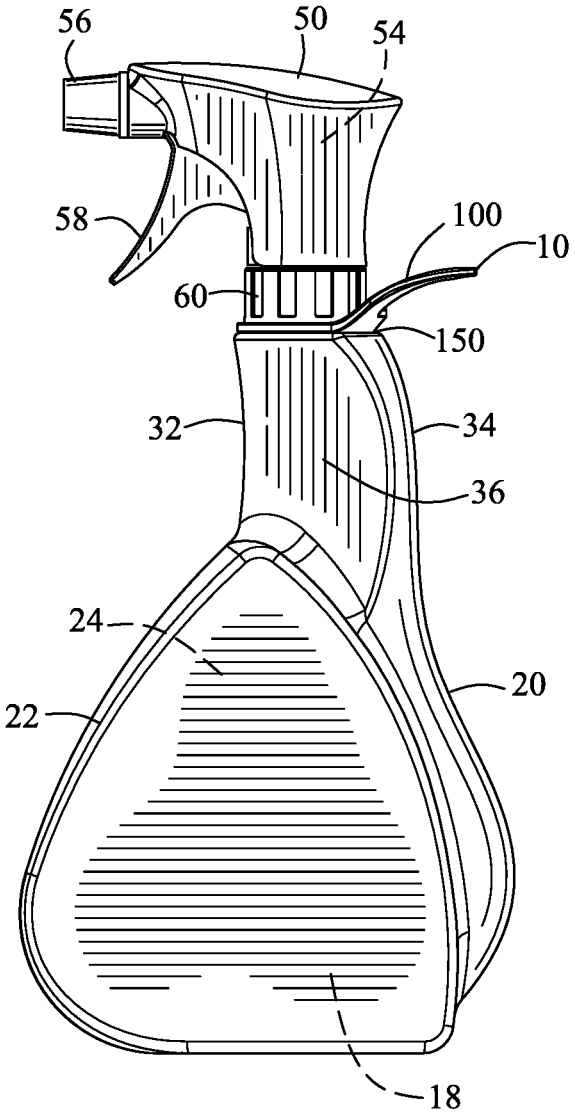
FIG. 16 is right side view of FIG. 15.
Figure 17:
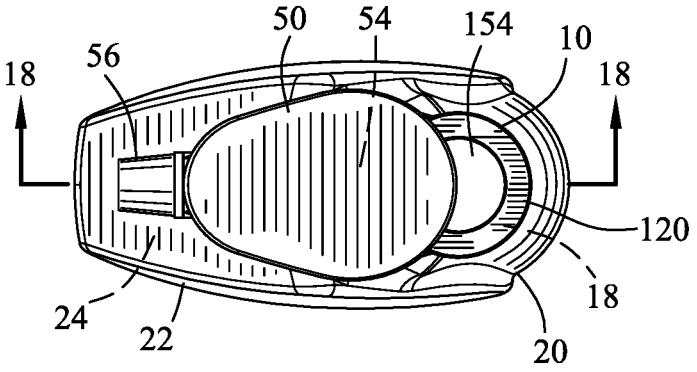
FIG. 17 is a top view of FIG. 16.
Figure 18:
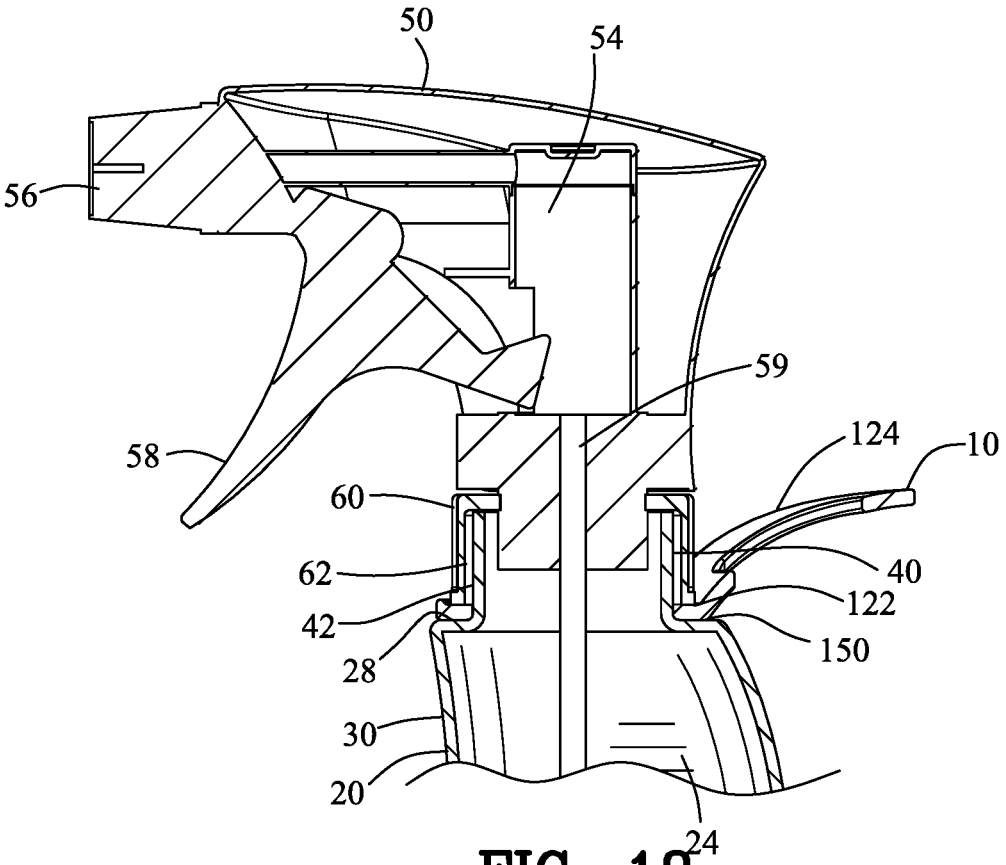
FIG. 18 is a sectional view along line 18-18 in FIG. 17.
Figure 19:
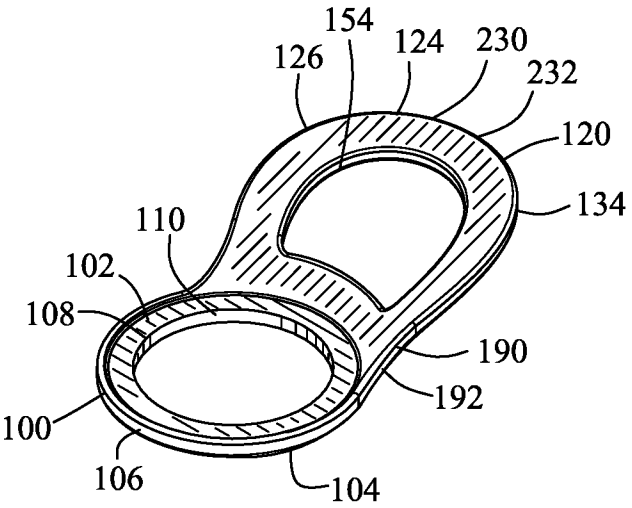
FIG. 19 is an upper isometric view of the container appendage of FIG. 15.
Figure 20:
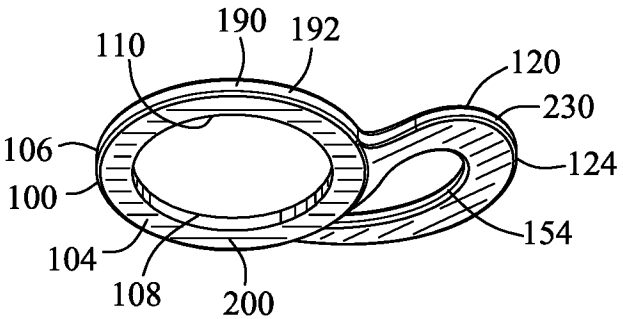
FIG. 20 is a lower isometric view of FIG. 19.
Figure 21:
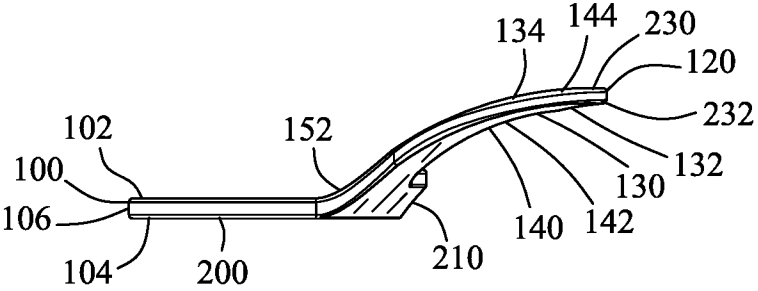
FIG. 21 is right side view of FIG. 19.
Figure 22:
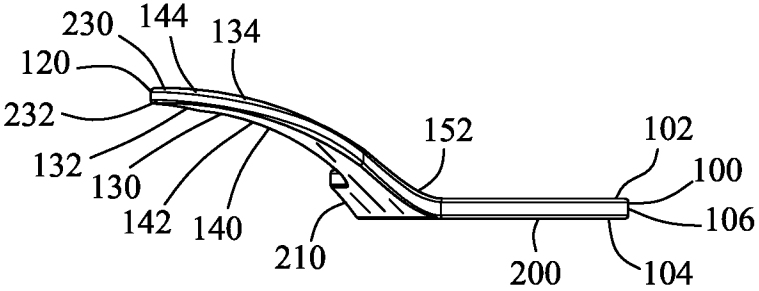
FIG. 22 is a left side view of FIG. 19.
Figure 23:
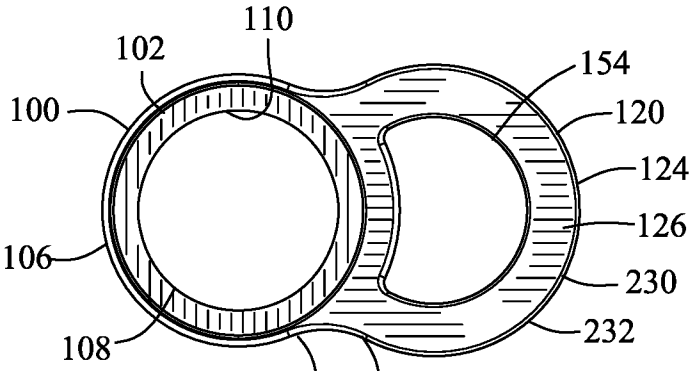
FIG. 23 is a top view of FIG. 19.
Figure 25:
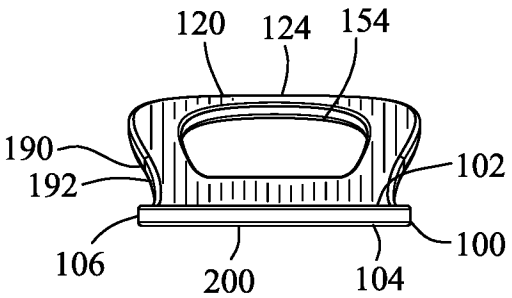
FIG. 25 is a front view of FIG. 19.
Figure 26:
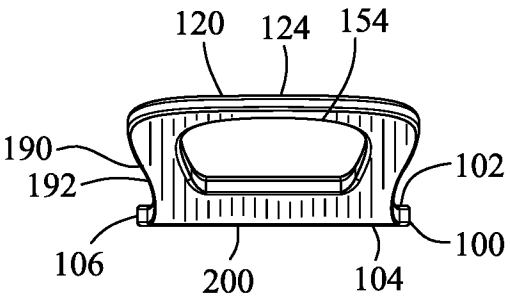
FIG. 26 is a rear view of FIG. 19.
Figure 24:
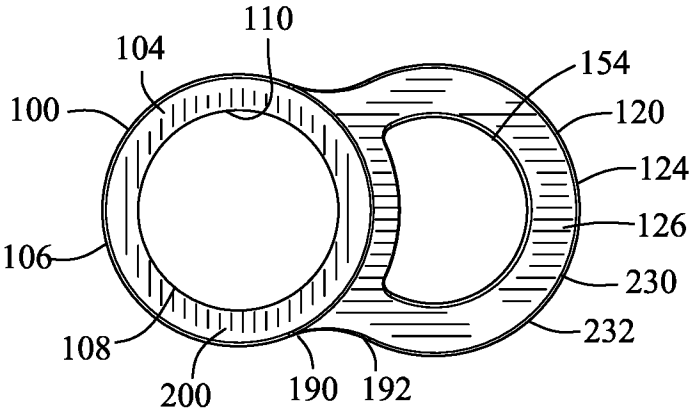
FIG. 24 is a bottom view of FIG. 19.
Figure 28:
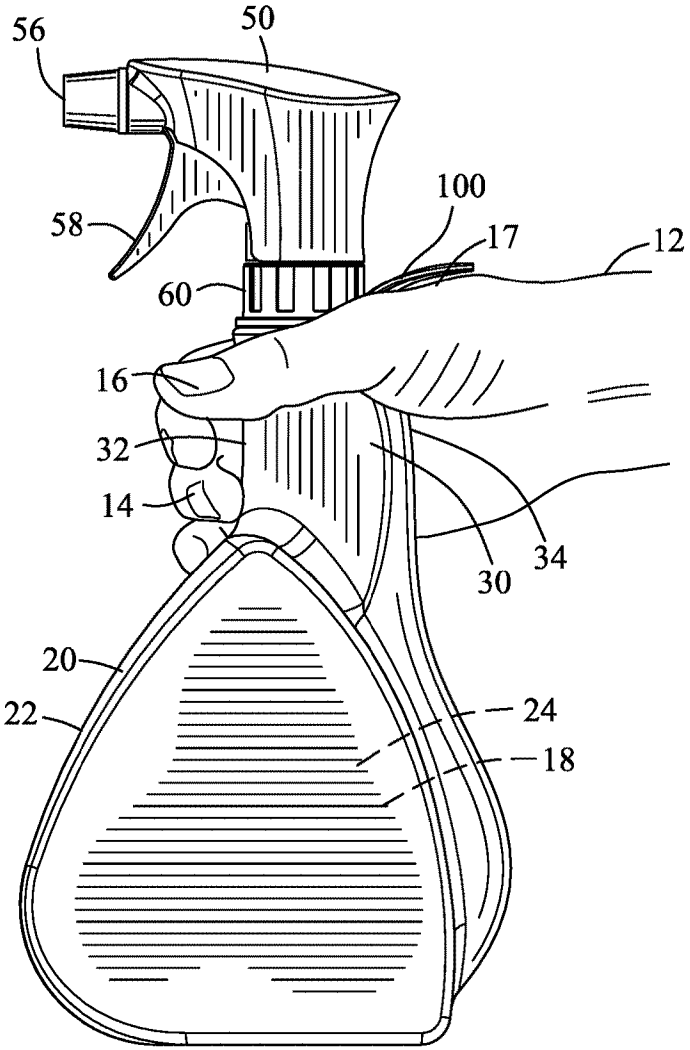
FIG. 28 is a view similar to FIG. 27 illustrating the hand engaging with the container appendage.
Figure 27:
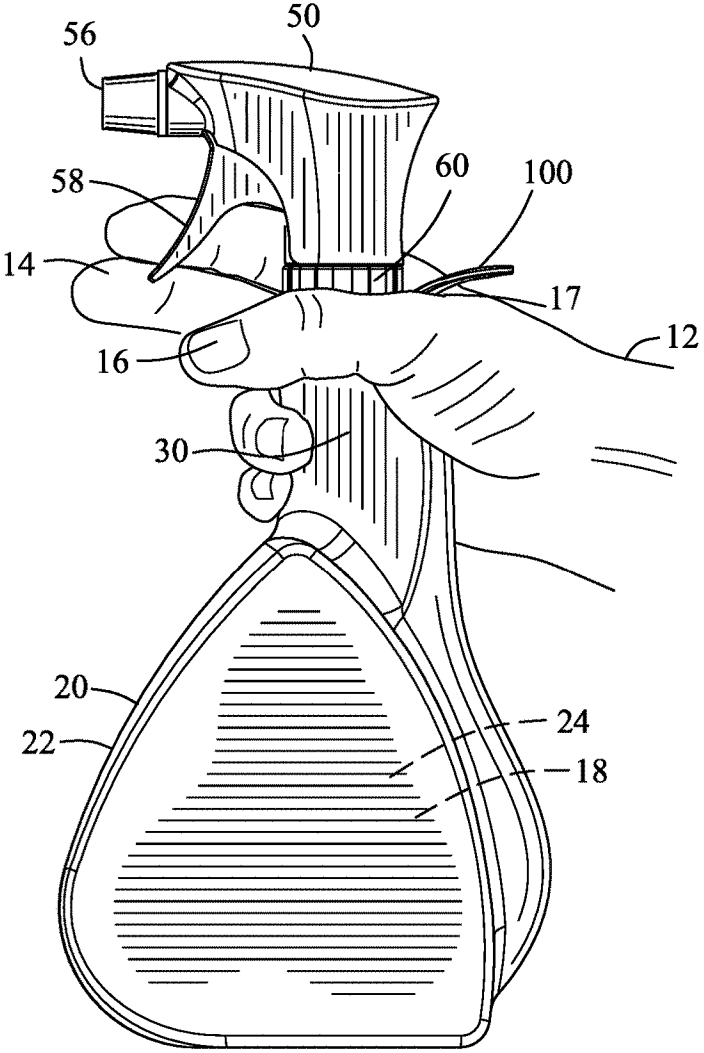
FIG. 27 is a view similar to FIG. 16 illustrating the hand engaging with the container appendage and the fingers engaging the trigger for dispensing a fluid.
Figure 29:
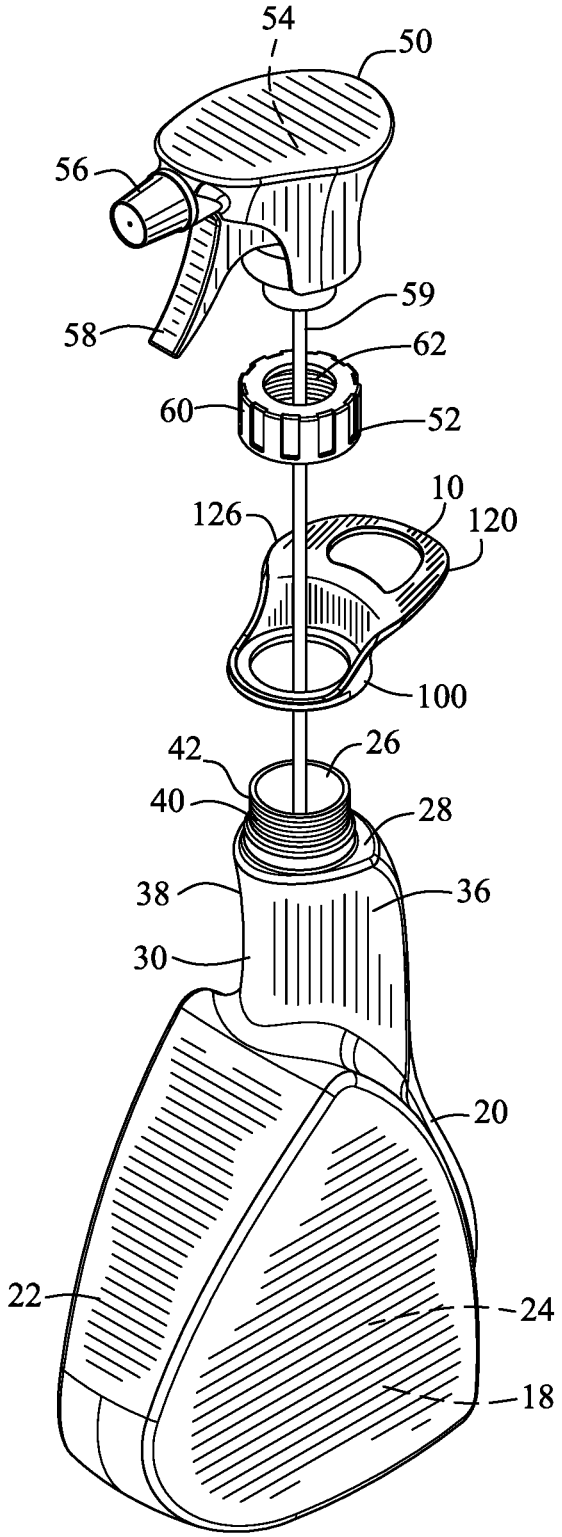
FIG. 29 is an exploded isometric view a third embodiment of a container appendage of the present invention positioned between a bottle and a spray body.
Figure 30:
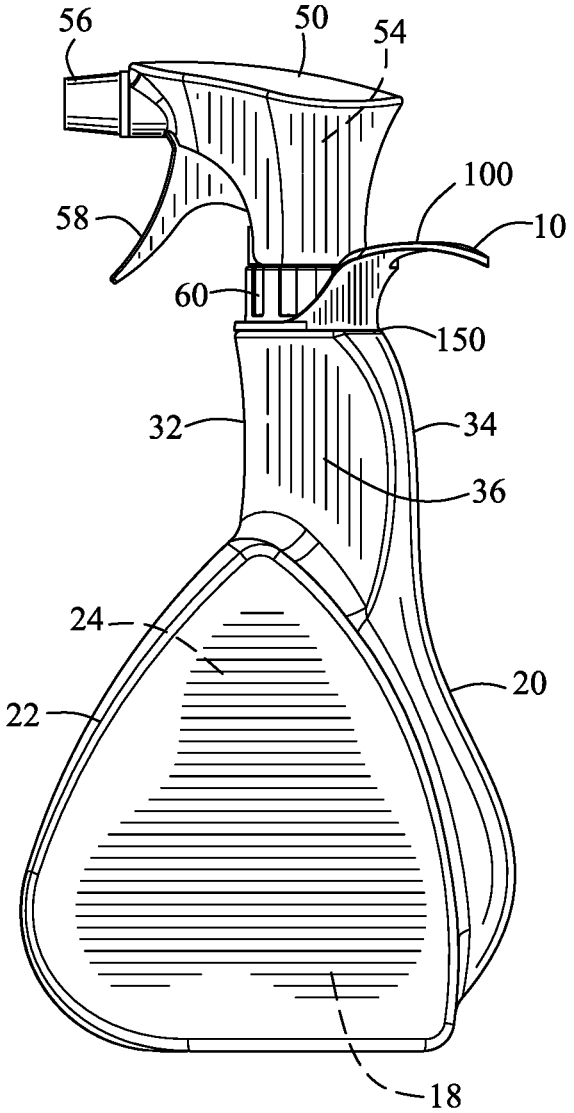
FIG. 30 is right side view of FIG. 29.
Figure 31:
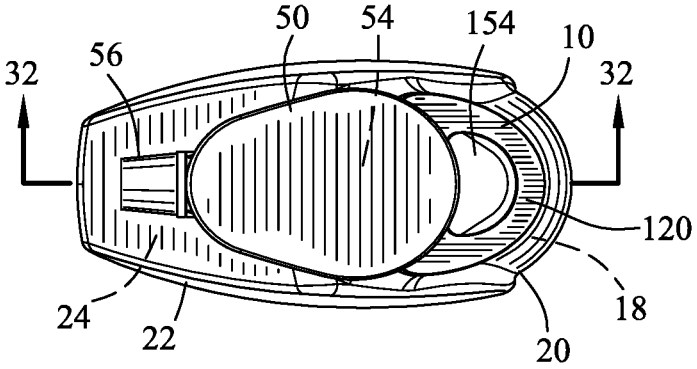
FIG. 31 is a top view of FIG. 30.
Figure 32:
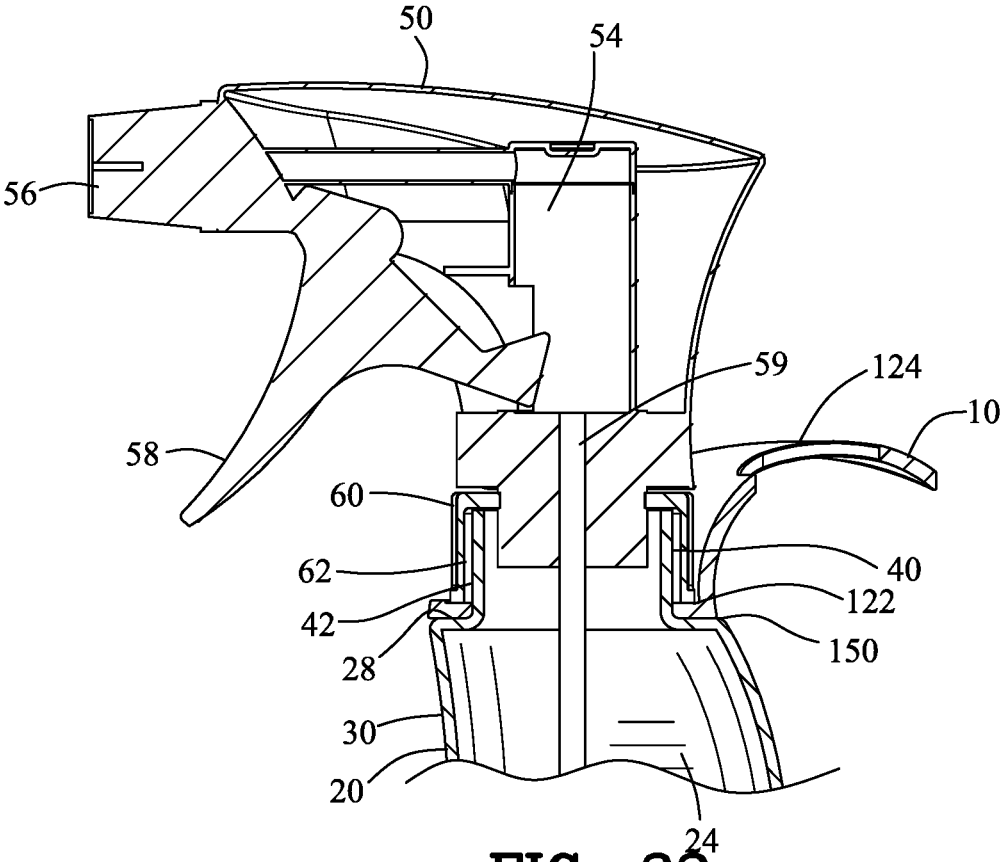
FIG. 32 is a sectional view along line 32-32 in FIG. 31.
Figure 35:
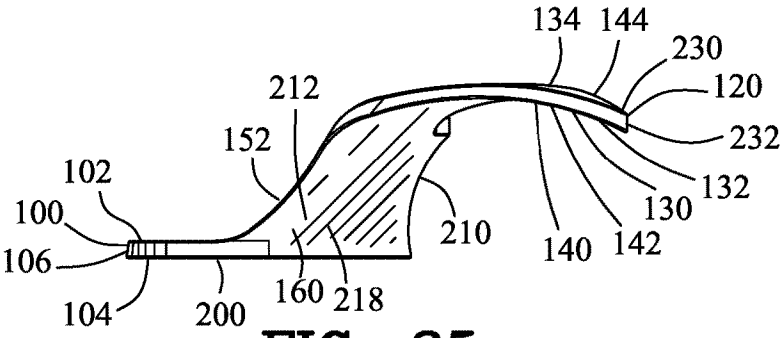
FIG. 35 is right side view of FIG. 33.
Figure 36:
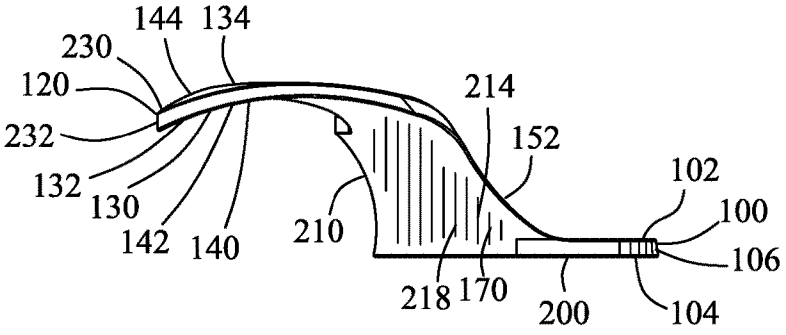
FIG. 36 is a left side view of FIG. 33.
Figure 33:
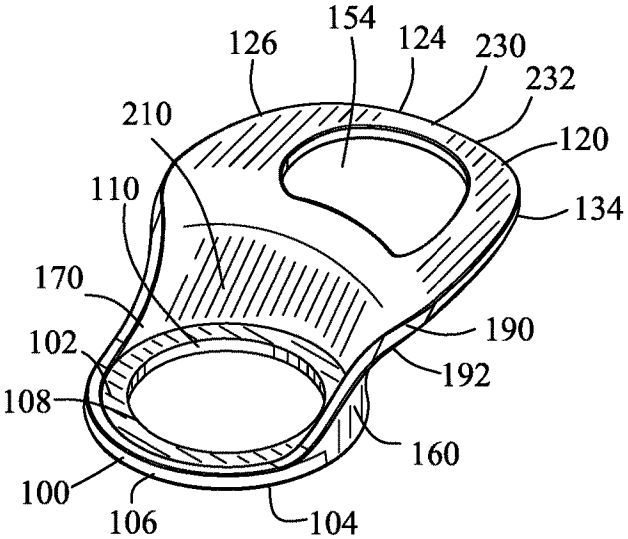
FIG. 33 is an upper isometric view of the container appendage of FIG. 29.
Figure 34:
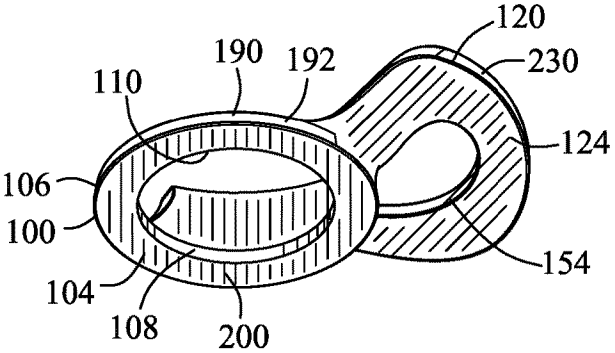
FIG. 34 is a lower isometric view of FIG. 33.
Figure 40:
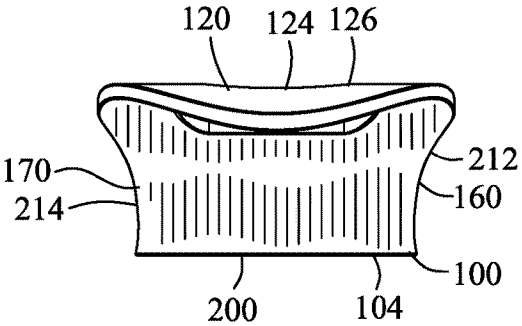
FIG. 40 is a rear view of FIG. 33.
Figure 39:
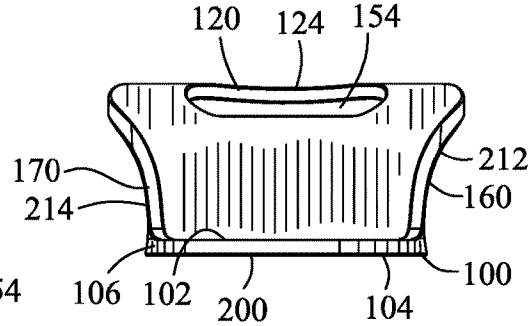
FIG. 39 is a front view of FIG. 33.
Figure 37:
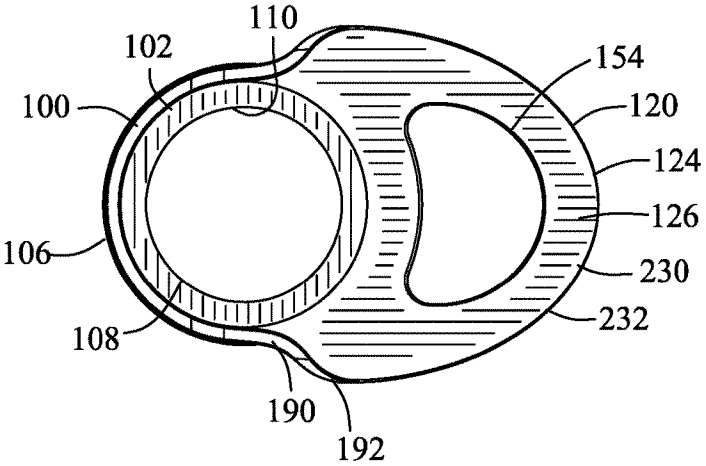
FIG. 37 is a top view of FIG. 33.
Figure 38:
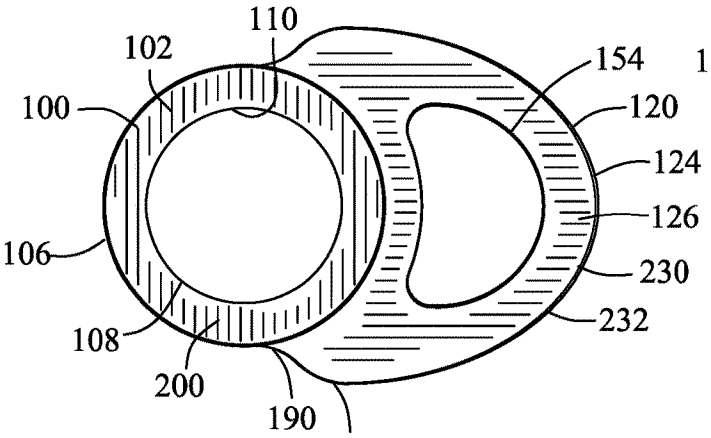
FIG. 38 is a bottom view of FIG. 33.
Figure 42:
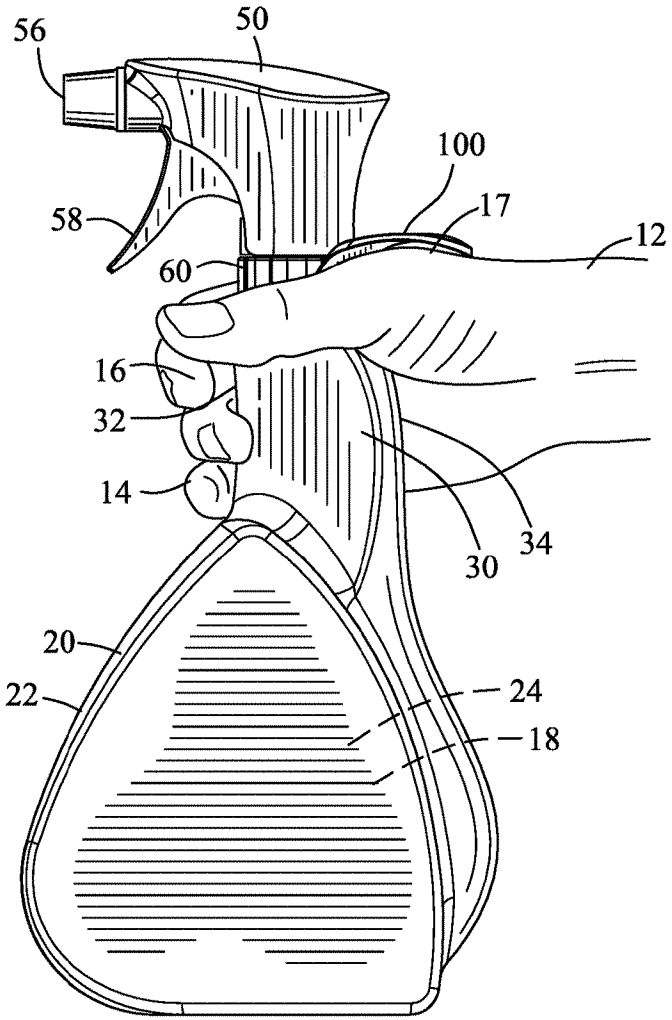
FIG. 42 is a view similar to FIG. 41 illustrating the hand engaging with the container appendage.
Figure 41:
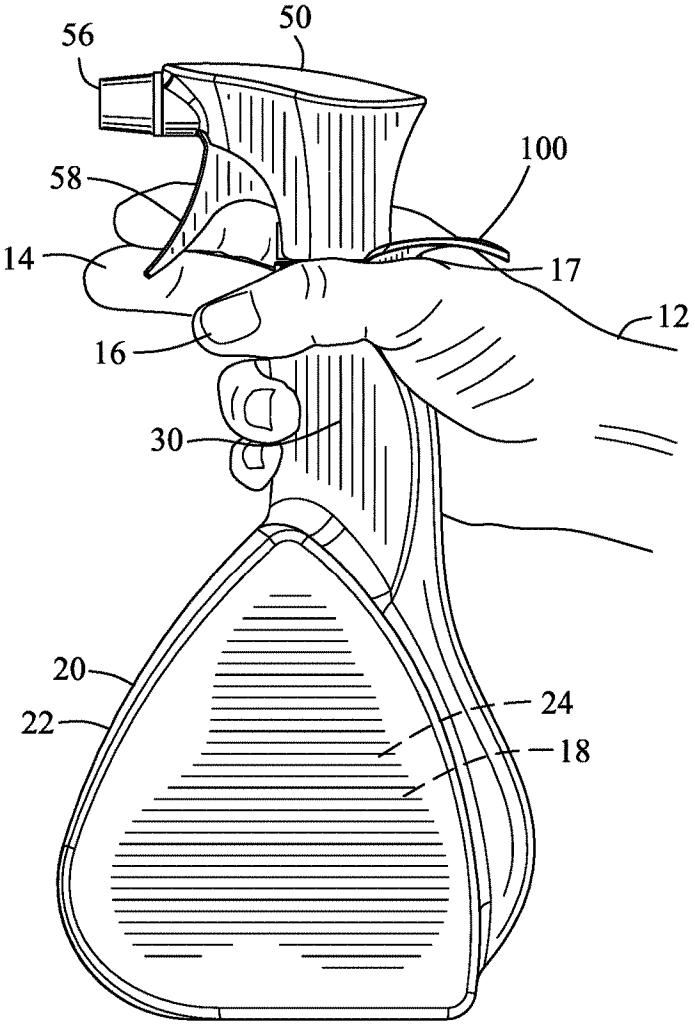
FIG. 41 is a view similar to FIG. 30 illustrating the hand engaging with the container appendage and the fingers engaging the trigger for dispensing a fluid.

FIGS. 1-42 illustrate a container appendage 10 engaging a trigger pump dispenser 20. The trigger pump dispenser or bottle 20 has a bottle body 22 defining a bottle chamber 24 for holding a liquid 18. A bottle aperture 26 provides access for inputting and outputting the liquid 18 relative to the bottle 20. The bottle 20 has a handling neck 30. The handling neck 30 has a front surface 32, a rear surface 34, first side surface 36 and a second side surface 38 for grasping by a hand 12. The bottle 20 may include a bottle closure deck 28.

The trigger pump dispenser or bottle 20 further includes a spray body 50. The spray body 50 encloses a pump 54. A nozzle 56 is coupled to the terminal end of the pump 54 for dispensing the liquid 18. A trigger 58 pivotably coupled to the spray body 50 operates the pump 54. A dip tube 59 positions the liquid 18 from within the bottle body 22 to the pump 54.

The bottle body 22 includes a bottle fitment 40. The spray body 50 includes a body fitment 52. The bottle fitment 40 engages with the body fitment 52 for coupling the bottle body 22 to the spray body 50. The bottle fitment 40 is shown to include a bottle threaded wall 42 and the body fitment 52 is shown to include a closure cap 60 having a closure threaded wall 62. The closure threaded wall 62 threadably engages with the bottle threaded wall 42 for coupling the spray body 52 the bottle body 22. Alternatively, the bottle fitment 40 and the body fitment 52 may include a snap fit, expansion joint fitting or other coupling means.

Prior art trigger pump dispensers were carried by the fingers 14 and the thumb 16 of the hand 12 encircling and compressing against the handling neck 30. Prior art trigger pump dispensers were dispensed by using the index finger and or the middle finger engaging the trigger 58. The third finger, little finger and thumb are utilized for encircling and compressing against the handling neck 30 during operation of the prior art trigger pump dispenser.

The container appendage 10 of the present invention improves the distribution of the load of the trigger pump dispenser 20 during both carrying and dispensing. More specifically, the container appendage 10 engages with the purlicue 17 portion of the hand 12 for relieving the fingers 14 and the thumb 16 from expending energy during carrying and dispensing the trigger pump dispenser 20. Furthermore, the container appendage 10 improves the ergonomical transportation and usage of the trigger pump dispenser 20 for enabling the user to operate the trigger pump dispenser 20 for longer durations without fatigue or discomfort. The container appendage 10 also provides more consistent fixturing of the users hand 12 relative to the trigger pump dispenser 20. The more consistent fixturing of the users hand 12 relative to the trigger pump dispenser 20 aids in maintaining an improved alignment and control during usage of the trigger pump dispenser 20 relative to the hand 12.

The container appendage 10 includes a mounting ring 100 having an upper surface 102, a lower surface 104, an exterior edge 106 and an interior edge 108 for defining a mounting aperture 110. A platform member 120 is coupled to the mounting ring 100. The mounting ring 100 is coupled between the bottle body 22 and the spray body 50 for defining a mounting ring couple 122. Preferably, the mounting ring 100 and the platform member 120 are constructed from an integral one-piece unit 126 from a polymeric material, metallic or other rigid material.

The platform member 120 cantilevers above the handling neck 30 and adjacent to the rear surface 34 for defining a rear ergonomical handling member 124 for conforming to the hand 12 and improving ergonomical grasping of the handling neck 30, actuating the trigger 58 and lifting the spray bottle 20 by the hand 12. More specifically, the platform member 120 engages with the purlicue 17 portion of the hand 12 for relieving the fingers 14 and the thumb 16 from expending energy during carrying and dispensing the trigger pump dispenser 20. Furthermore, the container appendage 10 improves the ergonomical transportation and usage of the trigger pump dispenser 20 for enabling the user to operate the trigger pump dispenser 20 for longer durations without fatigue or discomfort. The mounting ring 100 may include a keyed channel for interlocking with the bottle closure deck 28 or the spray body 50 for preventing rotation of the container appendage 10 relative to the bottle body 22.

The platform member 120 may includes a curved lower surface 130. The curved lower surface 130 of the platform member 120 extends from the handling neck 30 and adjacent to the rear surface 34 for defining a curved rear ergonomical handling member 132 for conforming to the hand 12 and improving ergonomical grasping of the handling neck 30, actuating the trigger 58 and lifting the spray bottle 20 by the hand 12. More specifically, the curved rear ergonomical handling member 132 engages with the purlicue 17 portion of the hand 12 for relieving the fingers 14 and the thumb 16 from expending energy during carrying and dispensing the trigger pump dispenser 20. Furthermore, the curved rear ergonomical handling member 132 improves the ergonomical transportation and usage of the trigger pump dispenser 20 for enabling the user to operate the trigger pump dispenser 20 for longer durations without fatigue or discomfort. Preferably, the mounting ring 100 and the curved lower surface 130 are constructed from an integral one-piece unit 134 from a polymeric material, metallic or other rigid material.

The platform member 120 may further include a concave lower surface 140. The concave lower surface 140 of the platform member 120 extends from the handling neck 30 and adjacent to the rear surface 34 for defining a concave rear ergonomical handling member 142 for conforming to the hand 12 and improving ergonomical grasping of the handling neck 30, actuating the trigger 58 and lifting the spray bottle 20 by the hand 12. More specifically, the concave rear ergonomical handling member 142 engages with the purlicue 17 portion of the hand 12 for relieving the fingers 14 and the thumb 16 from expending energy during carrying and dispensing the trigger pump dispenser 20. Furthermore, the concave rear ergonomical handling member 142 improves the ergonomical transportation and usage of the trigger pump dispenser 20 for enabling the user to operate the trigger pump dispenser 20 for longer durations without fatigue or discomfort. Preferably, the mounting ring 100 and the concave rear ergonomical handling member 142 are constructed from an integral one-piece unit 144 from a polymeric material, metallic or other rigid material.

The curved lower surface 130 or the concave lower surface 140 of the platform member 120 and the rear surface 34 of the handle neck 30 define a converging apex member 150 for further conforming to the hand 12 and improving ergonomical grasping of the handling neck 30, actuating the trigger 58 and lifting the spray bottle 20 by the hand 12. The converging apex member 150 assists in conforming to the hand 12 and improving ergonomical grasping of the handling neck 30, actuating the trigger 58 and lifting the spray bottle 20 by the hand 12.

The platform member 120 may include a flat member, an angled member, a contoured member, a multiple contoured member or other geometric shapes. Furthermore, platform member 120 may also include the convex lower surface multiple contoured lower surface or other designs or shapes. The platform member 120 may also include a flat lower surface, a convex lower surface multiple contoured lower surface or other designs or shapes.

The container appendage 10 may further include a first concave side wall 160 coupled to the mounting ring 100 and the platform member 120 for positioning adjacent the first side surface 36 of the handling neck 30. The first concave side wall 160 cantilevers above the handling neck 30 and adjacent to the first side surface 36 of the handling neck 30 for defining a first ergonomical side handling member 162 for conforming to the hand 12 and improving ergonomical grasping of the handling neck 30, actuating the trigger 58 and lifting the spray bottle 20 by the hand 12.

The container appendage 10 may further include a second concave side wall 170 coupled to the mounting ring 100 and the platform member 120 for positioning adjacent the second side surface 38 of the handling neck 30. The second concave side wall 170 cantilevers above the handling neck 30 and adjacent to the second side surface 38 of the handling neck 30 for defining a second ergonomical side handling member 172 for conforming to the hand 12 and improving ergonomical grasping of the handling neck 30, actuating the trigger 58 and lifting the spray bottle 20 by the hand 12.

The container appendage 10 may further include a front concave wall 180 coupled to the mounting ring 100 for positioning adjacent the front surface 32 of the handling neck 30. The front concave wall 180 cantilevers above the handling neck 30 and adjacent to the front surface 32 of the handling neck 30 for defining a front ergonomical handling member 182 for conforming to the hand 12 and improving ergonomical grasping of the handling neck 30, actuating the trigger 58 and lifting the spray bottle 20 by the hand 12.

The platform member 120, the first concave side wall 160, the second concave side wall 170 and the front concave wall 180 define an elliptical perimeter surface for defining a perimeter ergonomical handling member 190 for conforming to the hand 12 and improving ergonomical grasping of the handling neck 30, actuating the trigger 58 and lifting the spray bottle 20 by the hand 12. More specifically, the perimeter ergonomical handling member 190 engages with the purlicue 17 portion of the hand 12, the thumb 16 and the index finger for relieving the fingers 14 and the thumb 16 from expending energy during carrying and dispensing the trigger pump dispenser 20. Furthermore, the perimeter ergonomical handling member 190 improves the ergonomical transportation and usage of the trigger pump dispenser 20 for enabling the user to operate the trigger pump dispenser 20 for longer durations without fatigue or discomfort. Preferably, the mounting ring 100 and the perimeter ergonomical handling member 190 are constructed from an integral one-piece unit 192 from a polymeric material, metallic or other rigid material.

As shown in FIGS. 1-14, the container appendage 10 may further include a base plate 200 coupled to the mounting ring 100. The base plate 200 may serve to increase the contact area between the mounting ring 100 and the bottle closure deck 28. The base plate may include a forward base plate 202 and a rear base plate 204 that defines a keyed baseplate channel 206. The keyed baseplate channel 206 may interlock with the bottle closure deck 28 for preventing rotation of the container appendage 10 relative to the bottle body 22.

The container appendage 10 may further include a rear riser wall 210, a first riser side wall 212, a second riser side wall 214 and a front riser wall 216. The rear riser wall 210, the first riser side wall 212, the second riser side wall 214 and the front riser wall 216 distance the platform member 120, the first concave side wall 116, the second concave side wall 170 and the front concave wall 180 respectively in an ascending displacement. The ascending displacement of the platform member 120, the first concave side wall 116, the second concave side wall 170 and the front concave wall 180 positions the hand in a more ascending position relative to the spray body 50 and thereby orienting the fingers 14 of the hand 12 in a more linear orientation to activate the trigger 58. This more ascended position of the fingers 14 of the hand 12 relative to the spray body 50 relieving the fingers 14 and the thumb 16 from expending energy during carrying and dispensing the trigger pump dispenser 20. Furthermore, the rear riser wall 210, the first riser side wall 212, the second riser side wall 214 and the front riser wall 216 improves the ergonomical transportation and usage of the trigger pump dispenser 20 for enabling the user to operate the trigger pump dispenser 20 for longer durations without fatigue or discomfort. Preferably, the mounting ring 100 and the rear riser wall 210, the first riser side wall 212, the second riser side wall 214 and the front riser wall 216 are constructed from an integral one-piece unit 218 from a polymeric material, metallic or other rigid material.

The container appendage 10 may further include a first drain notch 220 and a second drain notch 222 for draining any liquid 14 that may accumulate within the mounting ring 100. More specifically, the first drain notch 220 and the second drain notch 222 would prevent any pooling of the liquid 14 that was dispensed from the nozzle 56 and traveled along the spray body 50 and ascending towards the bottle body 22. In addition, the first notch 220 and the second notch 222 may be enlarged for permitting easier and unobstructed access for threading and torquing the closure cap 60 with the bottle threaded wall 42 if utilized.

The platform member 120 may further be utilized for other purposes. For example the platform member 120 may include a distal edge 230. The distal edge 230 of the platform member 120 may define a scraper element 232. The scraper element 232 may be a texturized surface or a smooth surface. The scraper element 232 may further be hardened by a reinforcing metallic sleeve for preventing damage to the platform member 120. The distal edge 230 may include a linear edge similar to a paint scraper.

The distal edge 230 of the platform member 120 may also define a squeegee element 240. The squeegee element 240 may include a rubber sleeve that is overmolded over the platform element 120. The distal edge 230 may include an elongated linear edge similar to a squeegee tool.

The mounting ring 100 and the platform member 120 preferably define an obtuse angle 152 there between for positioning the platform member 120 above the mounting ring 100. The platform member 120 may further include a platform aperture 154. The platform aperture 154 may be utilized for placing the bottle 20 on a hook. In addition, the platform aperture 150 may be utilized for receiving a carabiner, engaging and retaining a rag with the bottle 20 for coupling other objects to the bottle 20.

Figure 43:
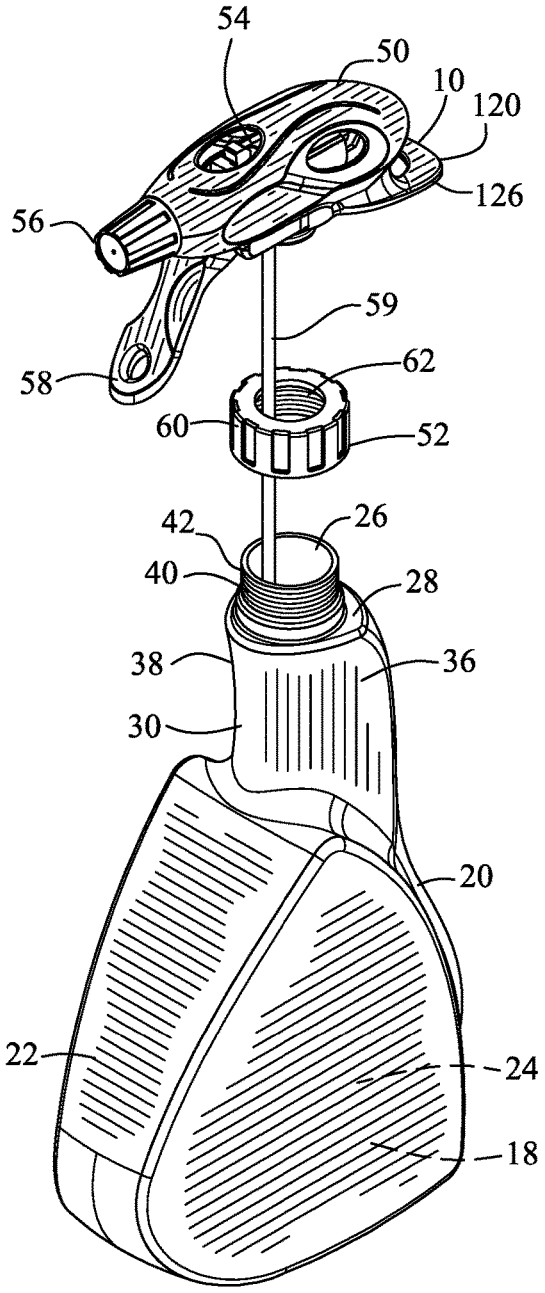
FIG. 43 is an exploded isometric view a fourth embodiment of a container appendage of the present invention positioned between a bottle and a spray body.
Figure 44:
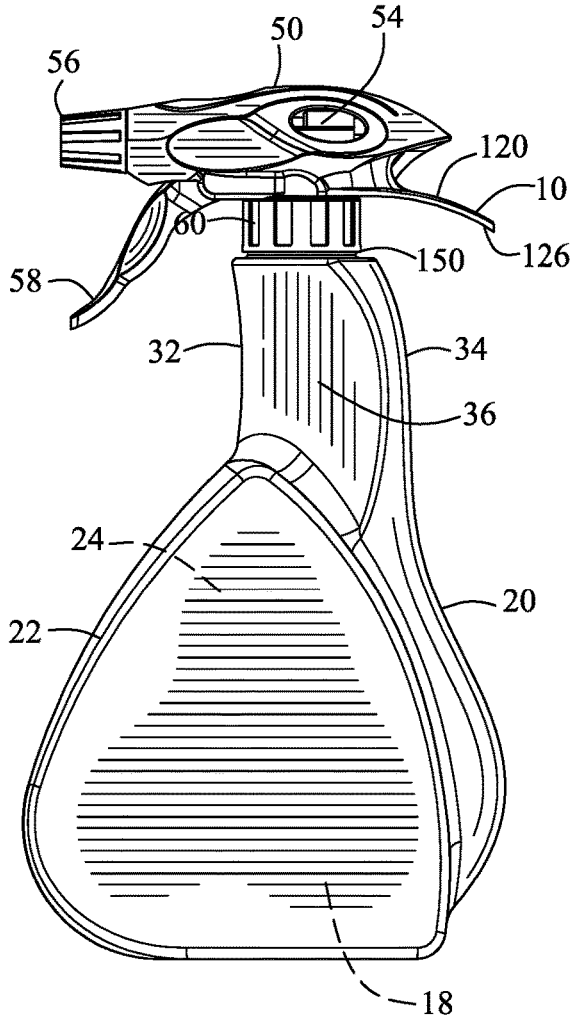
FIG. 44 is right side view of FIG. 43.
Figure 45:
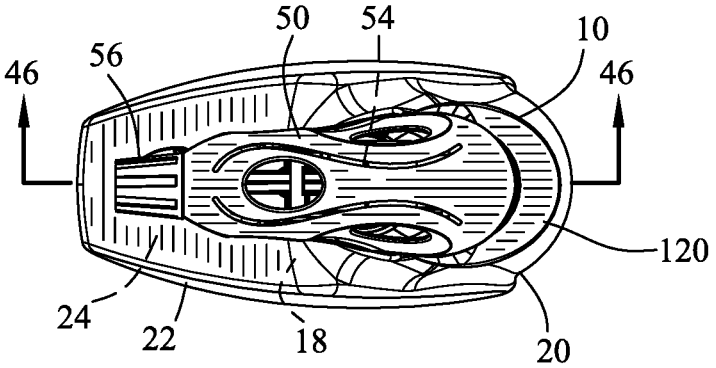
FIG. 45 is a top view of FIG. 44.
Figure 46:
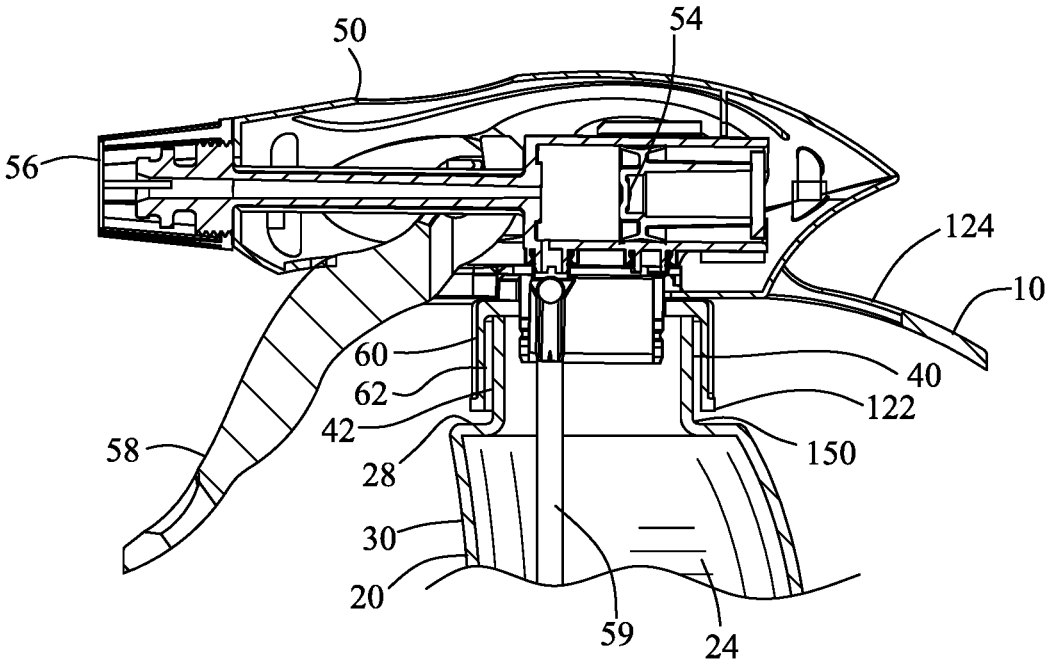
FIG. 46 is a sectional view along line 46-46 in FIG. 45.
Figure 47:
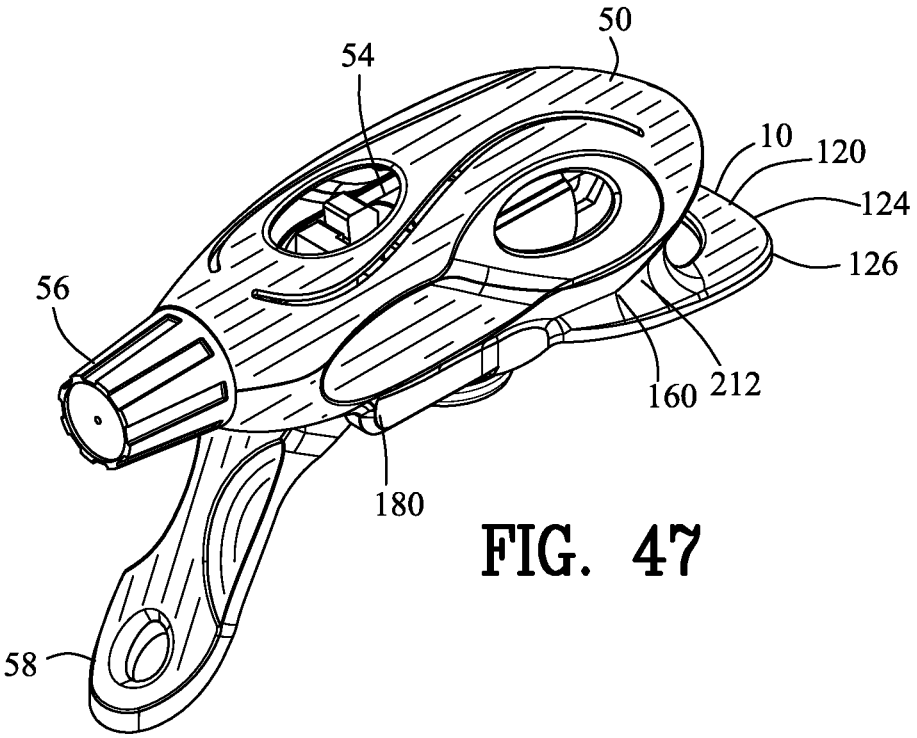
FIG. 47 is an upper front isometric view of the container appendage of FIG. 43.
Figure 48:
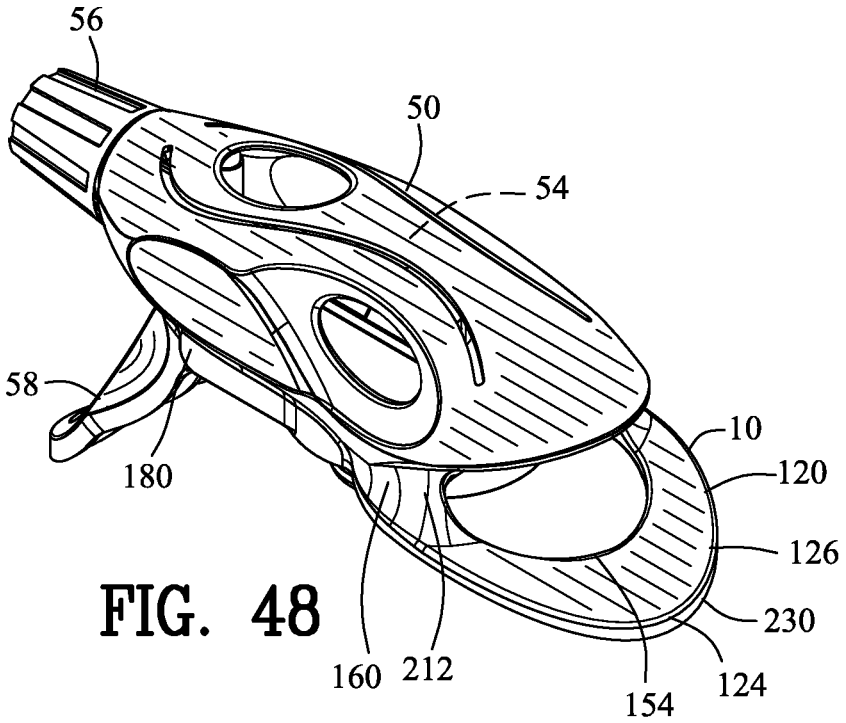
FIG. 48 is a lower front isometric view of FIG. 47 5.
Figure 49:
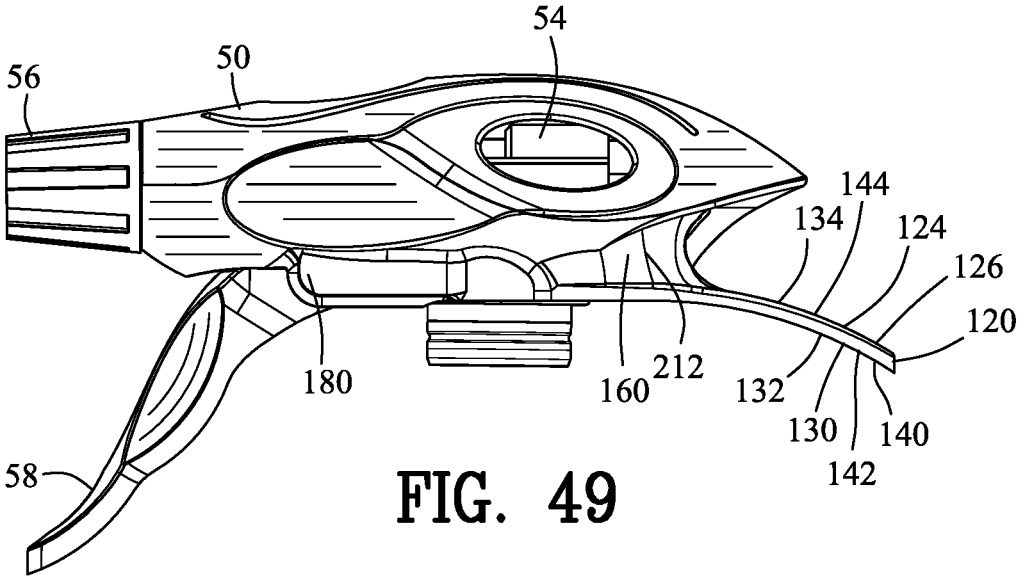
FIG. 49 is right side view of FIG. 47.
Figure 50:
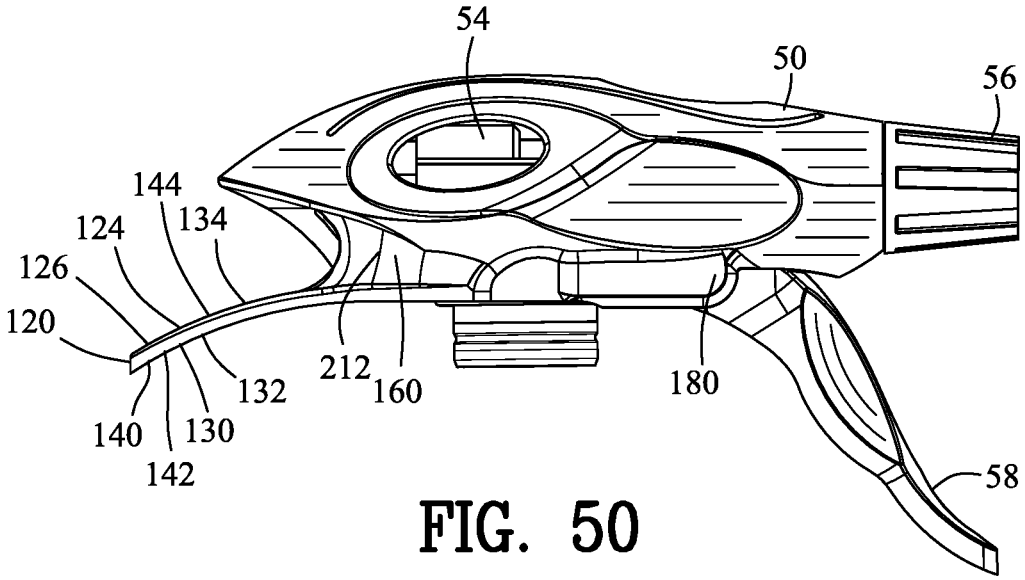
FIG. 50 is a left side view of FIG. 47.
Figure 51:
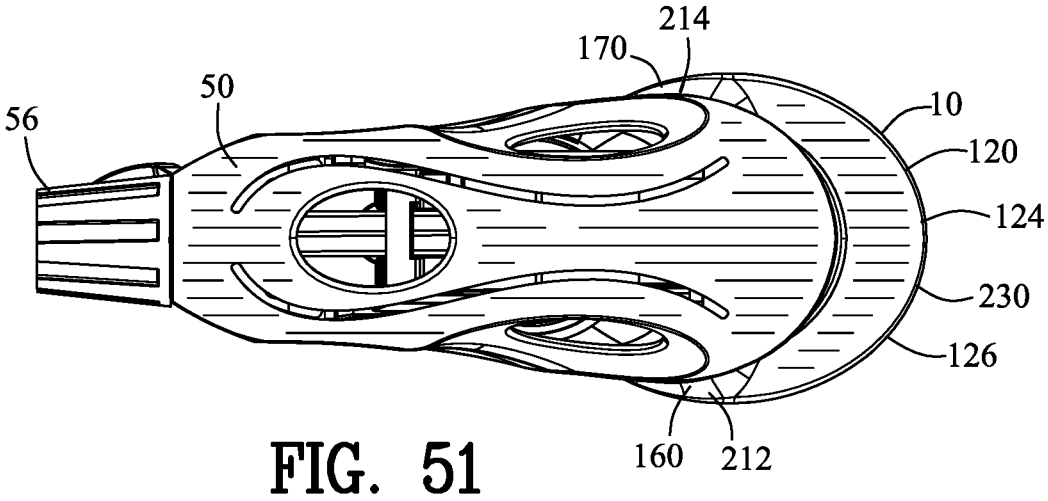
FIG. 51 is a top view of FIG. 47.
Figure 52:
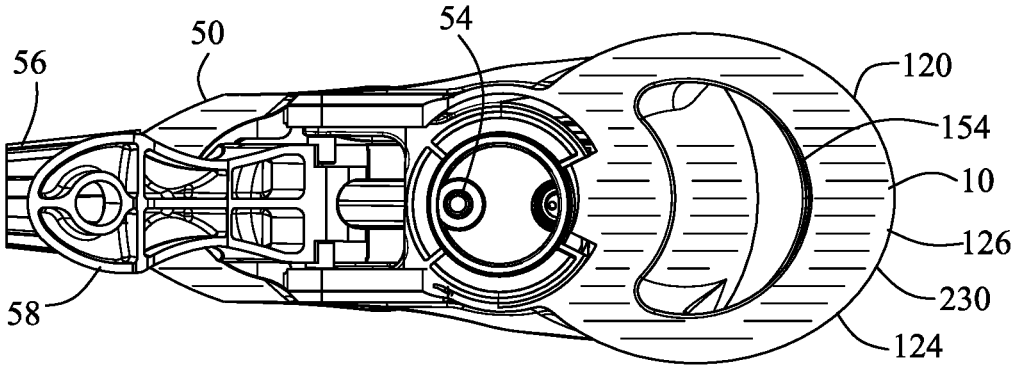
FIG. 52 is a bottom view of FIG. 47.
Figure 53:
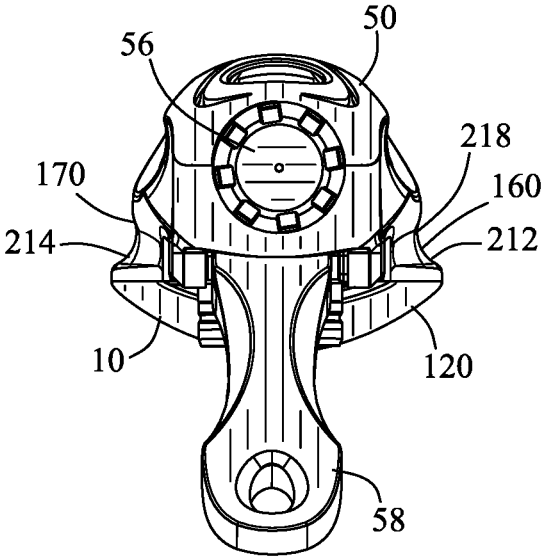
FIG. 53 is a front view of FIG. 47.
Figure 54:
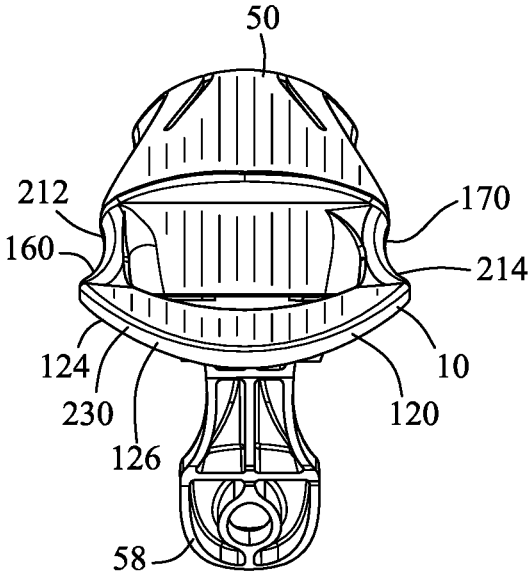
FIG. 54 is a rear view of FIG. 47.
Figure 56:
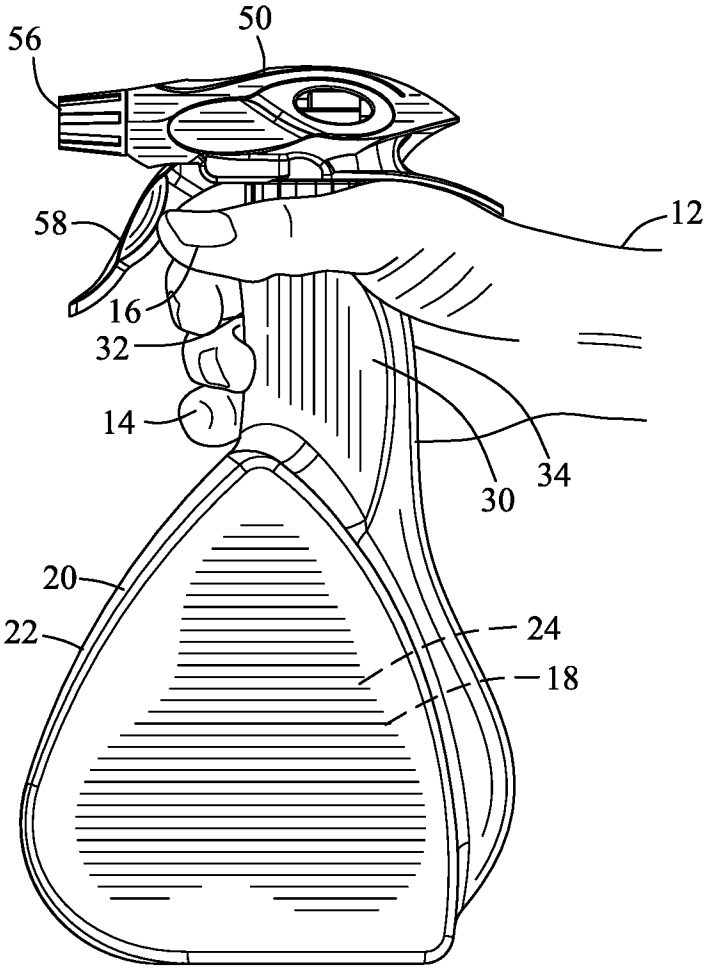
FIG. 56 is a view similar to FIG. 55 illustrating the hand engaging with the container appendage.
Figure 55:
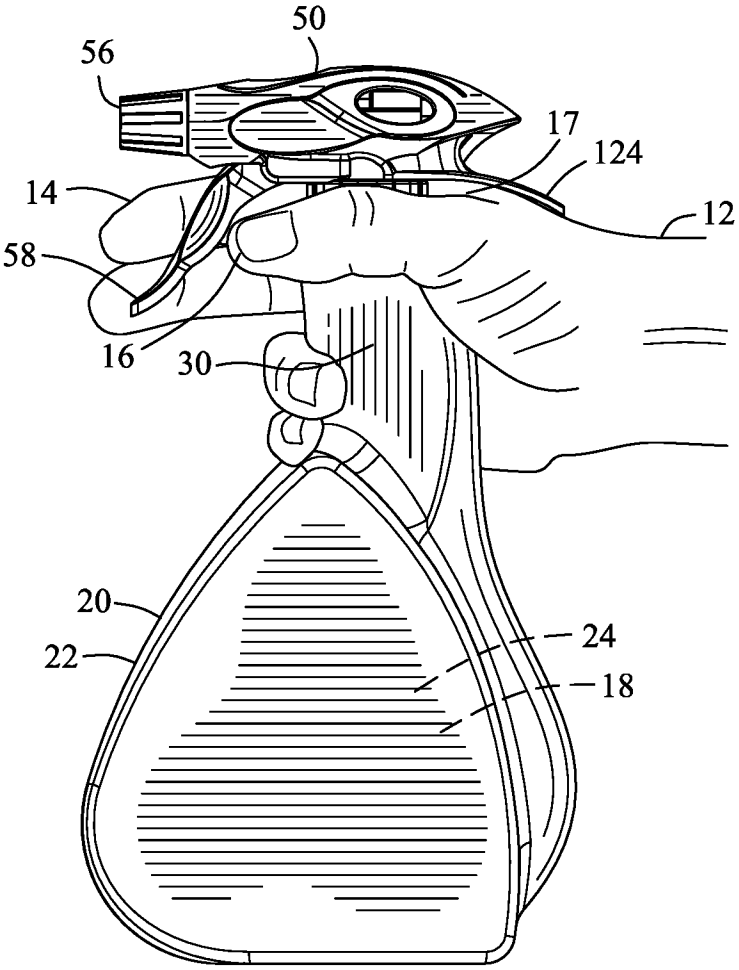
FIG. 55 is a view similar to FIG. 44 illustrating the hand engaging with the container appendage and the fingers engaging the trigger for dispensing a fluid.

FIGS. 43-56 illustrate the container appendage 10 being integrally formed with the spray body 50 for defining an improved spray dispenser 250. The improved spray dispenser 250 has a bottle body 22 defining a bottle chamber 24 for holding a liquid 18. A bottle aperture 26 provides access for inputting and outputting the liquid 18 relative to the improved spray dispenser 250. The improved spray dispenser 250 has a handling neck 30. The handling neck 30 has a front surface 32, a rear surface 34, first side surface 36 and a second side surface 38 for grasping by a hand 12. The improved spray dispenser 250 may include a bottle closure deck 28.

The trigger pump dispenser or improved spray dispenser 250 further includes a spray body 50. The spray body 50 encloses a pump 54. A nozzle 56 is coupled to the terminal end of the pump 54 for dispensing the liquid 18. A trigger 58 pivotably coupled to the spray body 50 operates the pump 54. A dip tube 59 positions the liquid 18 from within the bottle body 22 to the pump 54.

The bottle body 22 includes a bottle fitment 40. The spray body 50 includes a body fitment 52. The bottle fitment 40 engages with the body fitment 52 for coupling the bottle body 22 to the spray body 50. The bottle fitment 40 is shown to include a bottle threaded wall 42 and the body fitment 52 is shown to include a closure cap 60 having a closure threaded wall 62. The closure threaded wall 62 threadably engages with the bottle threaded wall 42 for coupling the spray body 52 the bottle body 22. Alternatively, the bottle fitment 40 and the body fitment 52 may include a snap fit, expansion joint fitting or other coupling means.

Prior art trigger pump dispensers were carried by the fingers 14 and the thumb 16 of the hand 12 encircling and compressing against the handling neck 30. Prior art trigger pump dispensers were dispensed by using the index finger and or the middle finger engaging the trigger 58. The third finger, little finger and thumb are utilized for encircling and compressing against the handling neck 30 during operation of the prior art trigger pump dispenser.

The improved spray dispenser 250 of the present invention improves the distribution of the load of the trigger pump dispenser 20 during both carrying and dispensing. More specifically, the improved spray dispenser 250 engages with the purlicue 17 portion of the hand 12 for relieving the fingers 14 and the thumb 16 from expending energy during carrying and dispensing the trigger pump dispenser 20. Furthermore, the improved spray dispenser 250 improves the ergonomical transportation and usage of the trigger pump dispenser 20 for enabling the user to operate the trigger pump dispenser 20 for longer durations without fatigue or discomfort. The improved spray dispenser 250 also provides more consistent fixturing of the users hand 12 relative to the spray body 50 and the bottle body 22. The more consistent fixturing of the users hand 12 relative to the improved spray dispenser 250 aids in maintaining an improved alignment and control during usage of the trigger pump dispenser 20 relative to the hand 12.

The improved spray dispenser 250 includes a platform member 120 coupled to the spray body 50. Preferably, the platform member 120 and the spray body 50 are constructed from an integral one-piece unit from a polymeric material, metallic or other rigid material.

The platform member 120 cantilevers above the handling neck 30 and adjacent to the rear surface 34 for defining a rear ergonomical handling member 124 for conforming to the hand 12 and improving ergonomical grasping of the handling neck 30, actuating the trigger 58 and lifting the spray bottle 20 by the hand 12. More specifically, the platform member 120 engages with the purlicue 17 portion of the hand 12 for relieving the fingers 14 and the thumb 16 from expending energy during carrying and dispensing the trigger pump dispenser 20. Furthermore, the improved spray dispenser 250 improves the ergonomical transportation and usage of the trigger pump dispenser 20 for enabling the user to operate the trigger pump dispenser 20 for longer durations without fatigue or discomfort.

The platform member 120 may includes a curved lower surface 130. The curved lower surface 130 of the platform member 120 extends from the handling neck 30 and adjacent to the rear surface 34 for defining a curved rear ergonomical handling member 132 for conforming to the hand 12 and improving ergonomical grasping of the handling neck 30, actuating the trigger 58 and lifting the spray bottle 20 by the hand 12. More specifically, the curved rear ergonomical handling member 132 engages with the purlicue 17 portion of the hand 12 for relieving the fingers 14 and the thumb 16 from expending energy during carrying and dispensing the trigger pump dispenser 20. Furthermore, the curved rear ergonomical handling member 132 improves the ergonomical transportation and usage of the trigger pump dispenser 20 for enabling the user to operate the trigger pump dispenser 20 for longer durations without fatigue or discomfort. Preferably, the platform member 120 and the curved lower surface 130 are constructed from an integral one-piece unit from a polymeric material, metallic or other rigid material.

The platform member 120 may further include a concave lower surface 140. The concave lower surface 140 of the platform member 120 extends from the handling neck 30 and adjacent to the rear surface 34 for defining a concave rear ergonomical handling member 142 for conforming to the hand 12 and improving ergonomical grasping of the handling neck 30, actuating the trigger 58 and lifting the spray bottle 20 by the hand 12. More specifically, the concave rear ergonomical handling member 142 engages with the purlicue 17 portion of the hand 12 for relieving the fingers 14 and the thumb 16 from expending energy during carrying and dispensing the trigger pump dispenser 20. Furthermore, the concave rear ergonomical handling member 142 improves the ergonomical transportation and usage of the trigger pump dispenser 20 for enabling the user to operate the trigger pump dispenser 20 for longer durations without fatigue or discomfort. Preferably, the platform member 120 and the concave rear ergonomical handling member 142 are constructed from an integral one-piece unit from a polymeric material, metallic or other rigid material.

The curved lower surface 130 or the concave lower surface 140 of the platform member 120 and the rear surface 34 of the handle neck 30 may define a converging apex member 150 for further conforming to the hand 12 and improving ergonomical grasping of the handling neck 30, actuating the trigger 58 and lifting the spray bottle 20 by the hand 12. The converging apex member 150 assists in conforming to the hand 12 and improving ergonomical grasping of the handling neck 30, actuating the trigger 58 and lifting the spray bottle 20 by the hand 12.

The platform member 120 may include a flat member, an angled member, a contoured member, a multiple contoured member or other geometric shapes. Furthermore, platform member 120 may also include the convex lower surface multiple contoured lower surface or other designs or shapes. The platform member 120 may also include a flat lower surface, a convex lower surface multiple contoured lower surface or other designs or shapes.

The improved spray dispenser 250 may further include a first concave side wall 160 coupled to the spray body 50 and the platform member 120 for positioning adjacent the first side surface 36 of the handling neck 30. The first concave side wall 160 cantilevers above the handling neck 30 and adjacent to the first side surface 36 of the handling neck 30 for defining a first ergonomical side handling member 162 for conforming to the hand 12 and improving ergonomical grasping of the handling neck 30, actuating the trigger 58 and lifting the spray bottle 20 by the hand 12.

The improved spray dispenser 250 may further include a second concave side wall 170 coupled to the spray body 50 and the platform member 120 for positioning adjacent the second side surface 38 of the handling neck 30. The second concave side wall 170 cantilevers above the handling neck 30 and adjacent to the second side surface 38 of the handling neck 30 for defining a second ergonomical side handling member 172 for conforming to the hand 12 and improving ergonomical grasping of the handling neck 30, actuating the trigger 58 and lifting the spray bottle 20 by the hand 12.

The improved spray dispenser 250 may further include a front concave wall 180 coupled to the spray body 50 for positioning adjacent the front surface 32 of the handling neck 30. The front concave wall 180 cantilevers above the handling neck 30 and adjacent to the front surface 32 of the handling neck 30 for defining a front ergonomical handling member 182 for conforming to the hand 12 and improving ergonomical grasping of the handling neck 30, actuating the trigger 58 and lifting the spray bottle 20 by the hand 12.

The platform member 120, the first concave side wall 160, the second concave side wall 170 and the front concave wall 180 define an elliptical perimeter surface for defining a perimeter ergonomical handling member 190 for conforming to the hand 12 and improving ergonomical grasping of the handling neck 30, actuating the trigger 58 and lifting the spray bottle 20 by the hand 12. More specifically, the perimeter ergonomical handling member 190 engages with the purlicue 17 portion of the hand 12, the thumb 16 and the index finger for relieving the fingers 14 and the thumb 16 from expending energy during carrying and dispensing the trigger pump dispenser 20. Furthermore, the perimeter ergonomical handling member 190 improves the ergonomical transportation and usage of the trigger pump dispenser 20 for enabling the user to operate the trigger pump dispenser 20 for longer durations without fatigue or discomfort. Preferably, the spray body 50 and the perimeter ergonomical handling member 190 are constructed from an integral one-piece unit 192 from a polymeric material, metallic or other rigid material.

The ascending displacement of the platform member 120, the first concave side wall 116, the second concave side wall 170 and the front concave wall 180 positions the hand in a more ascending position relative to the spray body 50 and thereby orienting the fingers 14 of the hand 12 in a more linear orientation to activate the trigger 58. This more ascended position of the fingers 14 of the hand 12 relative to the spray body 50 relieving the fingers 14 and the thumb 16 from expending energy during carrying and dispensing the trigger pump dispenser 20. Furthermore, the platform member 120, the first concave side wall 116, the second concave side wall 170 and the front concave wall 180 improves the ergonomical transportation and usage of the improved spray dispenser 250 enabling the user to operate the trigger pump dispenser 20 for longer durations without fatigue or discomfort. Preferably, the platform member 120, the first concave side wall 116, the second concave side wall 170 and the front concave wall 180 are constructed from an integral one-piece unit 218 from a polymeric material, metallic or other rigid material.

The platform member 120 may further be utilized for other purposes. For example the platform member 120 may include a distal edge 230. The distal edge 230 of the platform member 120 may define a scraper element 232. The scraper element 232 may be a texturized surface or a smooth surface. The scraper element 232 may further be hardened by a reinforcing metallic sleeve for preventing damage to the platform member 120. The distal edge 230 may include a linear edge similar to a paint scraper.

The distal edge 230 of the platform member 120 may also define a squeegee element 240. The squeegee element 240 may include a rubber sleeve that is overmolded over the platform element 120. The distal edge 230 may include an elongated linear edge similar to a squeegee tool.

The platform member 120 may further include a platform aperture 154. The platform aperture 154 may be utilized for placing the bottle 20 on a hook. In addition, the platform aperture 150 may be utilized for receiving a carabiner, engaging and retaining a rag with the bottle 20 for coupling other objects to the bottle 20.

The present disclosure includes that contained in the appended claims as well as the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A container appendage engaging a bottle, the bottle having a bottle fitment, the bottle having a handling neck below the bottle fitment, the handling neck having a front surface, a rear surface, first side surface and a second side surface for grasping by a hand, a spray body having a body fitment, the body fitment engaging with the bottle fitment for coupling the spray body with the bottle, the spray body dispensing a liquid from a nozzle upon actuating a trigger, the container appendage, comprising:

a mounting ring having an upper surface, a lower surface, an exterior edge and an interior edge for defining a mounting aperture;

a platform member coupled to said mounting ring;

said mounting ring coupling between the bottle and the spray body for defining a mounting ring couple;

said platform member cantilevering above the handling neck and adjacent to the rear surface for defining a rear ergonomical handling member for conforming to the hand and improving ergonomical grasping of the handling neck, actuating the trigger and lifting the spray bottle by the hand;

a first concave side wall coupled to said mounting Hun and said platform member for positioning adjacent the first side surface of the handling neck;

said first concave side wall cantilevering above the handling neck and adjacent to the first side surface of the handling neck for defining a first ergonomical side handling member for conforming to the hand and improving ergonomical grasping of the handling neck, actuating the trigger and lifting the spray bottle by the hand;

a second concave side wall coupled to said mounting ring and said platform member for positioning adjacent the second side surface of the handling neck; and said second concave side wall cantilevering above said handling neck and adjacent to the second side surface of the handling neck for defining a second ergonomical side handling member for conforming to the hand and improving ergonomical grasping of the handling neck, actuating the trigger and lifting the spray bottle by the hand.

2. The container appendage as set forth in claim 1, wherein said platform member includes a curved lower surface; and said curved lower surface of said platform member extending from the handling neck and adjacent to the rear surface for defining a curved rear ergonomical handling member for conforming to the hand and improving ergonomical grasping of the handling neck, actuating the trigger and lifting the spray bottle by the hand.

3. The container appendage as set forth in claim 2, wherein said curved lower surface of said platform member and the rear surface of the handle define a converging apex member for conforming to the hand and improving ergonomical grasping of the handling neck, actuating the trigger and lifting the spray bottle by the hand.

4. The container appendage as set forth in claim 1, wherein said platform member includes a concave lower surface; and said concave lower surface of said platform member extending from the handling neck and adjacent to the rear surface for defining a concave rear ergonomical handling member for conforming to the hand and improving ergonomical grasping of the handling neck, actuating the trigger and lifting the spray bottle by the hand.

5. The container appendage as set forth in claim 1, wherein said mounting ring and said platform member define an obtuse angle there between for positioning said platform member above said mounting ring.

6. The container appendage as set forth in claim 1, further including a platform aperture in said platform member for hanging the bottle.

7. The container appendage as set forth in claim 1, further including a front concave wall coupled to said mounting ring for positioning adjacent the front surface of the handling neck;

said front concave wall cantilevering above the handling neck and adjacent to the front surface of the handling neck for defining a front ergonomical handling member for conforming to the hand and improving ergonomical grasping of the handling neck, actuating the trigger and lifting the spray bottle by the hand.

8. The container appendage as set forth in claim 1, further including a front concave wall coupled to said mounting ring for positioning adjacent the front surface of the handling neck;

said front concave wall cantilevering above the handling neck and adjacent to the front surface of the handling neck for defining a front ergonomical handling member for conforming to the hand and improving ergonomical grasping of the handling neck, actuating the trigger and lifting the spray bottle by the hand; and said platform member, said first concave side wall, said second concave side wall and said front concave wall defining an elliptical perimeter surface for defining a perimeter ergonomical handling member for conforming to the hand and improving ergonomical grasping of the handling neck, actuating the trigger and lifting the spray bottle by the hand.

9. The handling appendage as set forth in claim 1, further including a base plate coupled to said mounting ring for increasing the contact area between said mounting ring, the bottle and the spray body.

10. The container appendage as set forth in claim 1, wherein said platform member includes a distal edge; and said distal edge of said platform member defining a scraper element.

11. An improved spray dispenser for dispensing a liquid, a hand engaging the spray dispenser, the unproved spray body, comprising:

a spray body including a nozzle for dispensing the liquid upon actuating a trigger pivotably mourned on said spray body;

said spray body including an upper surface and a lower surface;

a spray body fitment coupling to said spray body;

a spray bottle storing the liquid;

said spray bottle including a bottle fitment;

said bottle fitment engaging said spray body fitment for coupling said spray bottle with said spray body;

said spray bottle having a handling neck below said bottle fitment;

said handling neck having a front surface, a rear surface, first side surface and a second side surface for grasping by the hand;

a platform member coupling to said spray body;

said platform member cantilevering above said handling neck and adjacent to said rear surface for defining a rear ergonomical handling member for conforming to the hand and improving ergonomical grasping of said handling neck, actuating said trigger and lifting said spray bottle by the hand; and said spray body and said platform member defining an integral one-piece unit.

12. The improved spray dispenser as set forth in claim 11, wherein said platform member includes a curved lower surface; and said curved lower surface of said platform member extending adjacent to said rear surface for defining a curved rear ergonomical handling member for conforming to the hand and improving ergonomical grasping of said handling neck, actuating said trigger and lifting said spray bottle by the hand.

13. The improved spray dispenser as set forth in claim 12, wherein said curved lower surface of said platform member and said rear surface of said handling neck define a converging apex member for conforming to the hand and improving ergonomical grasping of said handling neck, actuating said trigger and lifting said spray bottle by the hand.

14. The improved spray dispenser as set forth in claim 11, wherein said platform member includes concave lower surface; and said concave lower surface of said platform member extending adjacent to said rear surface for defining a concave rear ergonomical handling member for conforming to the hand and improving ergonomical grasping of said handling neck, actuating said trigger and lifting said spray bottle by the hand.

15. The improved spray dispenser as set forth in claim 11, further including a platform aperture in said platform member for hanging the spray bottle; said platform aperture located beyond said spray body fitment.

16. The improved spray dispenser as set forth in claim 11, further including a first concave side wall coupled to said spray body and said platform member for positioning on said first side surface of said handling neck;

said first concave side wall cantilevering above said handling neck and adjacent to said first side member of said handling neck for defining a first ergonomical side handling member for conforming to the hand and improving ergonomical grasping, said handling neck, actuating said trigger and lifting said spray bottle by the hand;

a second concave side wall coupled to said spray body and said platform member for positioning on said second side surface of said handling neck; and said second concave side wall cantilevering above said handling neck and adjacent to said second side surface for defining a second ergonomical side handling member for conforming to the hand and improving ergonomical grasping said handling neck, actuating said trigger and lifting said spray bottle by the hand.

17. The improved spray dispenser as set forth in claim 11, further including a front concave wall coupled to said spray body for positioning on said front surface of said handling neck; and said front concave wall cantilevering above said handling neck and adjacent to said front surface of said handling neck for defining a front ergonomical handling member for conforming to the hand and improving ergonomical grasping said handling neck, actuating said trigger and lifting said spray bottle by the hand.

18. The improved spray dispenser as set forth in claim 11, further including a first concave side wall coupled to said spray body and said platform member for positioning on said first side surface of said handling neck;

said first concave side wall cantilevering above said handling neck and adjacent to said first side member of said handling neck for defining a first ergonomical side handling member for conforming to the hand and improving ergonomical grasping said handling neck, actuating said trigger and lifting said spray bottle by the hand;

a second concave side wall coupled to said spray body and said platform member for positioning on said second side surface of said handling neck;

said second concave side wall cantilevering above said handling neck and adjacent to said second side surface for defining a second ergonomical side handling member for conforming to the hand and improving ergonomical grasping said handling neck, actuating said trigger and lifting said spray bottle by the hand;

a from concave wall coupled to said spray body for positioning on said front surface of said handling neck;

said front concave wall cantilevering above said handling neck and adjacent to said front surface of said handling neck for defining a front ergonomical handling member for conforming to the hand and improving ergonomical grasping said handling neck, actuating said trigger and lifting said spray bottle by the hand; and said platform member, said first concave side wall, said second concave side wall and said front concave wall defining an elliptical perimeter surface for defining a perimeter ergonomical handling member for conforming to the hand and improving ergonomical grasping said handling neck, actuating said trigger and lifting said spray bottle by the hand.

19. The improved spray dispenser as set forth in claim 11, wherein said platform member includes a distal edge; and said distal edge of said platform member defining a scraper element.

20. An improved spray dispenser for dispensing a liquid, a hand engaging the spray dispenser, the improved spray body, comprising:

a spray body including a nozzle for dispensing the liquid upon actuating a trigger pivotably mounted on said spray body;

said spray body including an upper surface and a lower surface;

a spray body fitment coupling to said spray body;

a spray bottle storing the liquid;

said spray bottle including a bottle fitment;

said bottle fitment engaging said spray body fitment for coupling said spray bottle with said spray body;

said spray bottle having a handling neck below said bottle fitment;

said handling neck having a front surface, a rear surface, first side surface and a second side surface for grasping by the hand;

a platform member coupling to said spray body;

said platform member cantilevering above said handling neck and adjacent to said rear surface for defining a rear ergonomical handling member for conforming to the hand and improving ergonomical grasping of said handling neck, actuating said trigger and lifting said spray bottle by the hand;

a first concave side wall coupled to said spray body and said platform member for positioning on said first side surface of said handling neck;

said first concave side wall cantilevering above said handling neck and adjacent to said first side member of said handling neck for defining a first ergonomical side handling member for conforming to the hand and improving ergonomical grasping said handling neck, actuating; said trigger and lifting said spray bottle by the hand;

a second concave side wall coupled to said spray body and said platform member for positioning on said second side surface of said handling neck; and said second concave side wall cantilevering above said handling neck and adjacent to said second side surface for defining a second ergonomical side handling member for conforming to the hand and improving ergonomical grasping said handling neck, actuating said trigger and lifting said spray bottle by the hand.

21. A container appendage engaging a bottle, the bottle having a bottle fitment, the bottle having a handling neck below the bottle fitment, the handling neck having a front surface, a rear surface, first side surface and a second side surface for grasping by a hand, a spray body having a body fitment, the body fitment engaging with the bottle fitment for coupling the spray body with the bottle, the spray body dispensing, a liquid from a nozzle upon actuating a trigger, the container appendage, comprising:

a mounting ring having an upper surface, a lower surface, an exterior edge and an interior edge for defining a mounting aperture;

said mounting ring coupling between the bottle and the spray, body for defining a mounting ring couple;

a side wall coupled to said mounting ring for positioning adjacent the side surface of the handling neck; and said side wall cantilevering above the handling neck and adjacent to the side surface of the handling neck for defining an ergonomical side handling ember for conforming to the hand and improving ergonomical grasping of the handling neck, actuating the trigger and lifting the spray bottle by the hand.

22. A container appendage engaging a bottle, the bottle having a bottle fitment, the bottle having a handling neck below the bottle fitment, the handling neck having a front surface, a rear surface, first side surface and a second side surface for grasping by a hand, a spray body having a body fitment, the body fitment engaging with the bottle fitment for coupling the spray body with the bottle, the spray body dispensing a liquid from a nozzle upon actuating a trigger, the container appendage, comprising:

a mounting ring having an upper surface, a lower surface, an exterior edge and an interior edge for defining a mounting aperture;

a platform member coupled to said mounting ring;

said mounting ring coupling between the bottle and the spray body for defining a mounting ring couple;

said platform member cantilevering above the handling neck and adjacent to the rear surface for defining a rear ergonomical handling member for conforming to the hand and improving ergonomical grasping of the handling neck, actuating the trigger and lifting the spray bottle by the hand;

a side wall coupled to said mounting ring and said platform member for positioning adjacent the side surface of the handling neck; and said side wall cantilevering above the handling neck and adjacent to the side surface of the handling neck for defining an ergonomical side handling member for conforming to the hand and improving ergonomical grasping of the handling neck, actuating the trigger and lifting the spray bottle by the hand.

23. A container appendage engaging a bottle, the bottle having a bottle fitment, the bottle having a handling neck below the bottle fitment, the handling neck having a front surface, a rear surface, first side surface and a second side surface for grasping by a hand, a spray body having a body fitment, the body fitment engaging with the bottle fitment for coupling the spray body with the bottle, the spray body dispensing a liquid from a nozzle upon actuating a trigger, the container appendage, comprising:

a mounting ring having an upper surface, a lower surface, an exterior edge and an interior edge for defining a mounting aperture;

said mounting ring coupling between the bottle and the spray body for defining a mounting dug couple;

a first side wall coupled to said mounting ring and said platform member for positioning adjacent the first side surface of the handling neck;

said first side wall cantilevering above the handling neck and adjacent to the first side surface of the handling neck for defining a first ergonomical side handling member for conforming to the hand and improving ergonomical grasping of the handling neck, actuating the trigger and lifting the spray bottle by the hand;

a second side wall coupled to said mounting ring and said platform member for positioning adjacent the second side surface of the handling neck; and said second side wall cantilevering above said handling neck and adjacent to the second side surface of the handling neck for defining a second ergonomical side handling member for conforming to the hand and improving ergonomical grasping of the handling neck, actuating the trigger and lifting the spray bottle by the hand.

24. A container appendage engaging a bottle, the bottle having a bottle fitment, the bottle having a handling neck below the bottle fitment, the handling neck having a front surface, a rear surface, first side surface and a second side surface for grasping by a hand, a spray body having a body fitment, the body fitment engaging with the bottle fitment for coupling the spray body with the bottle, the spray body dispensing a liquid from a nozzle upon actuating a trigger, the container appendage, comprising:

a mounting ring having an upper surface, a lower surface, an exterior edge and an interior edge for defining a mounting aperture;

said mounting ring coupling between the bottle and the spray body for defining a mounting ring couple;

a first side wall coupled to said mounting ring and said platform member for positioning adjacent the first side surface of the handling neck;

said first side wall cantilevering above the handling neck and adjacent to the first side surface of the handling neck for defining a first ergonomical side handling member for conforming to the hand and improving ergonomical grasping of the handling neck, actuating the trigger and lifting the spray bottle by the hand;

a second side wall coupled to said mounting ring and said platform member for positioning adjacent the second side surface of the handling neck;

said second side wall cantilevering above said handling neck and adjacent to the second side surface of the handling neck for defining a second ergonomical side handling member for conforming to the hand and improving ergonomical grasping of the handling neck, actuating the trigger and lifting the spray bottle by the hand;

a front wall coupled to said mounting ring for positioning adjacent the front surface of the handling neck; and said front wall cantilevering above the handling neck and adjacent to the front surface of the handling neck for defining a front ergonomical handling member for conforming to the hand and improving ergonomical grasping of the handling neck, actuating the trigger and lifting the spray bottle by the hand.

25. An improved spray dispenser for dispensing a liquid, hand engaging the spray dispenser, the improved spray body, comprising:

a spray body including a nozzle for dispensing the liquid upon actuating a trigger pivotably mounted on said spray body;

said spray body including an upper surface and a lower surface;

a spray body fitment coupling to said spray body;

a spray bottle storing the liquid;

said spray bottle including a bottle fitment;

said bottle fitment engaging said spray body fitment for coupling said spray bottle with said spray body;

said spray bottle having a handling neck below said bottle fitment;

said handling neck having a front surface, a rear surface, first side surface and a second side surface for grasping by the hand;

a side wall coupled to said spray body for positioning on said side surface of said handling neck;

said side wall cantilevering above said handling neck and adjacent to said side member of said handling neck for defining an ergonomical side handling member for conforming to the hand and improving ergonomical grasping said handling, neck, actuating said trigger and lifting said spray bottle by the hand.

26. An improved spray dispenser for dispensing a liquid, a hand engaging the spray dispenser, the improved spray body, comprising:

a spray body including a nozzle for dispensing the liquid upon actuating a trigger pivotably mounted on said spray body;

said spray body including an upper surface and a lower surface;

a spray body fitment coupling to said spray body;

a spray bottle storing the liquid;

said spray bottle including a bottle fitment;

said bottle fitment engaging said spray body fitment for coupling said spray bottle with said spray body;

said spray bottle having a handling neck below said bottle fitment;

said handling neck having a front surface, a rear surface, first side surface and a second side surface for grasping by the hand;

a platform member coupling to said spray body;

said platform member cantilevering above said handling neck and adjacent to said rear surface for defining a rear ergonomical handling member for conforming to the hand and improving ergonomical grasping of said handling neck, actuating said trigger and lifting said spray bottle by the hand:

a side wall coupled to said spray body and said platform member for positioning on said side surface of said handling neck;

said side wall cantilevering above said handling neck and adjacent to said side member of said handling neck for defining an ergonomical side handling member for conforming to the hand and improving ergonomical grasping said handling neck, actuating said trigger and lifting said spray bottle by the hand.

27. An improved spray dispenser for dispensing a liquid, a hand engaging the spray dispenser, the improved spray body, comprising:

a spray body including a nozzle for dispensing the liquid upon actuating a trigger pivotably mounted on said spray body;

said spray body including an upper surface and a lower surface;

a spray body fitment coupling to said spray body;

a spray bottle storing the liquid;

said spray bottle including a bottle fitment;

said bottle fitment engaging said spray body fitment for coupling said spray bottle with said spray body;

said spray bottle having a handling neck below said bottle fitment;

said handling neck having a front surface, a rear surface, first side surface and a second side surface for grasping by the hand;

a first side wall coupled to said spray body and said platform member for positioning on said first side surface of said handling neck;

said first side wall cantilevering above said handling neck and adjacent to said first side member of said handling neck for defining a first ergonomical side handling member for conforming to the hand and improving ergonomical grasping said handling neck, actuating said trigger and lifting said spray bottle by the hand;

a second side wall coupled to said spray body and said platform member for positioning on said second side surface of said handling neck; and said second side wall cantilevering above said handling neck and adjacent to said second side surface for defining a second ergonomical side handling member for conforming to the hand and improving ergonomical grasping said handling neck, actuating said trigger and lifting said spray bottle by the hand.

28. An in proved spray dispenser for dispensing a liquid, a hand engaging the spray dispenser, the improved spray body, comprising:

a spray body including a nozzle for dispensing the liquid upon actuating a trigger pivotably mounted on said spray body;

said spray body including an upper surface and a lower surface;

a spray body fitment coupling to said spray body;

a spray bottle storing the liquid;

said spray bottle including a bottle fitment;

said bottle fitment engaging said spray body fitment for coupling said spray bottle with said spray body;

said spray bottle having a handling neck below said bottle fitment;

said handling neck having a front surface, a rear surface, first side surface and a second side surface for grasping by the hand;

a first side wall coupled to said spray body and said platform member for positioning on said first side surface of said handling neck;

said first side wall cantilevering above said handling neck and adjacent to said first side member of said handling neck for defining a first ergonomical side handling member for conforming to the hand and improving ergonomical grasping said handling neck, actuating said trigger and lifting said spray bottle by the hand;

a second side wall coupled to said spray body and said platform member for positioning on said second side surface of said handling neck;

said second side wall cantilevering above said handling neck and adjacent to said second side surface for defining a second ergonomical side handling member for conforming to the hand and improving ergonomical grasping said handling neck, actuating said trigger and lifting said spray bottle by the hand;

a front wall coupled to said spray body for positioning on said front surface of said handling neck; and said front wall cantilevering above said handling neck and adjacent to said front surface of said handling neck for defining a from ergonomical handling member for conforming to the hand and improving ergonomical grasping said handling neck, actuating said trigger and lifting said spray bottle by the hand.

* * * * *